US008023844B2

(12) United States Patent
Kawada et al.

(10) Patent No.: US 8,023,844 B2
(45) Date of Patent: Sep. 20, 2011

(54) IMAGE FORMING APPARATUS AND METHOD FOR STABLY DETECTING AN IMAGE

(75) Inventors: Kunihiro Kawada, Matsumoto (JP); Yujiro Nomura, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 403 days.

(21) Appl. No.: 12/203,737

(22) Filed: Sep. 3, 2008

(65) Prior Publication Data

US 2009/0060543 A1 Mar. 5, 2009

(30) Foreign Application Priority Data

Sep. 3, 2007 (JP) ..... 2007-227617
Jul. 14, 2008 (JP) ..... 2008-182751

(51) Int. Cl.
*G03G 15/00* (2006.01)

(52) U.S. Cl. ..... 399/49; 399/301; 399/302

(58) Field of Classification Search ..... 399/49, 399/301, 302
See application file for complete search history.

(56) References Cited

U.S. PATENT DOCUMENTS 6,567,171 B1 * 5/2003 Rushing ..... 356/432
2004/0101327 A1 * 5/2004 Nomura et al. ..... 399/111
2008/0181667 A1 * 7/2008 Nomura et al. ..... 399/218

FOREIGN PATENT DOCUMENTS

JP 03045972 A * 2/1991

* cited by examiner

*Primary Examiner* — David Gray
*Assistant Examiner* — G. M. Hyder
(74) *Attorney, Agent, or Firm* — DLA Piper LLP (US)

(57) ABSTRACT

An image forming apparatus, includes: an exposure head that includes an imaging optical system which is arranged in a first direction and a light emitting element which emits light to be focused by the imaging optical system; a latent image carrier that moves in a second direction orthogonal to or substantially orthogonal to the first direction and carries a latent image which is formed by the exposure head; a developing unit that develops the latent image formed on the latent image carrier by the exposure head; and a detector that detects an image which is developed by the developing unit and is formed using one imaging optical system.

11 Claims, 36 Drawing Sheets

Dsm>Wlm

IMAGE FORMING APPARATUS AND METHOD FOR STABLY DETECTING AN IMAGE

CROSS REFERENCE TO RELATED APPLICATION

The disclosure of Japanese Patent Applications No. 2007-227617 filed on Sep. 3, 2007 and No. 2008-182751 filed on Jul. 14, 2008 including specification, drawings and claims is incorporated herein by reference in its entirety.

BACKGROUND

1. Technical Field

The invention relates to techniques for stabilizing a result of detecting an image.

2. Related Art

There has been conventionally known an image forming apparatus for forming a test image (that is, detection image or image-to-be-detected) and detecting this test image to obtain information relating to image formation. For example, an image forming apparatus disclosed in Japanese Patent No. 2642351 forms test images ("detection pattern" of Japanese Patent No. 2642351) for a plurality of colors and obtains color misregistration information necessary for color image formation. Specifically, the apparatus disclosed in Japanese Patent No. 2642351 forms a color image by superimposing toner images of a plurality of colors on a transfer medium. In order to satisfactorily form this color image, test images are formed for the respective colors. The test images are detected by optical sensors and the positions of the test images are obtained from the detection results. The color misregistration information can be obtained from the thus obtained positions of the test images of the respective colors. In this way, the test images are formed and the information relating to image formation is obtained from the detection results on the test images in the apparatus disclosed in Japanese Patent No. 2642351.

SUMMARY

In order to realize the formation of an image with high resolution, the following line head can be used. This line head includes a plurality of light emitting elements grouped into light emitting element groups. The respective light emitting element groups emit light beams toward the surface of the latent image carrier moving in a sub scanning direction and can expose regions mutually different in a main scanning direction orthogonal to the sub scanning direction. In the case of forming a test image, the light emitting element groups expose the surface of the latent image carrier to form a test latent image and the test latent image is developed to form the test image. However, due to a variation of a moving speed of the surface of the latent image carrier, the position of a latent image formed by the different light emitting element groups may vary in the sub scanning direction in some cases. A similar variation is seen also in the test image obtained by developing the test latent image having such a variation. As a result, there have been cases where the detection result on the test image becomes unstable.

An advantage of some aspects of the invention is to stably detect an image even if the above variation occurs in the image.

According to a first aspect of the invention, there is provided an image forming apparatus, comprising: an exposure head that includes an imaging optical system which is arranged in a first direction and a light emitting element which emits light to be focused by the imaging optical system; a latent image carrier that moves in a second direction orthogonal to or substantially orthogonal to the first direction and carries a latent image which is formed by the exposure head; a developing unit that develops the latent image formed on the latent image carrier by the exposure head; and a detector that detects an image which is developed by the developing unit and is formed using one imaging optical system.

According to a second aspect of the invention, there is provided an image forming method, comprising: forming a latent image by an exposure head that includes an imaging optical system which is arranged in a first direction and a light emitting element which emits light to be focused by the imaging optical system using one imaging optical system; developing the latent image formed by the exposure head; detecting an image developed in the developing; and forming an image based on a detection result in the detecting.

According to a third aspect of the invention, there is provided an image detecting method, comprising: forming a latent image, by means of an exposure head that includes an imaging optical system which is arranged in a first direction and a light emitting element which emits light to be focused by the imaging optical system, on a latent image carrier that moves in a second direction orthogonal to or substantially orthogonal to the first direction; developing the latent image formed by the exposure head; and detecting an image that is developed in the developing and is formed using one imaging optical system.

The above and further objects and novel features of the invention will more fully appear from the following detailed description when the same is read in connection with the accompanying drawing. It is to be expressly understood, however, that the drawing is for purpose of illustration only and is not intended as a definition of the limits of the invention.

DESCRIPTION OF EXEMPLARY EMBODIMENTS

I. Basic Construction of an Image Forming Apparatus

Figure 1:
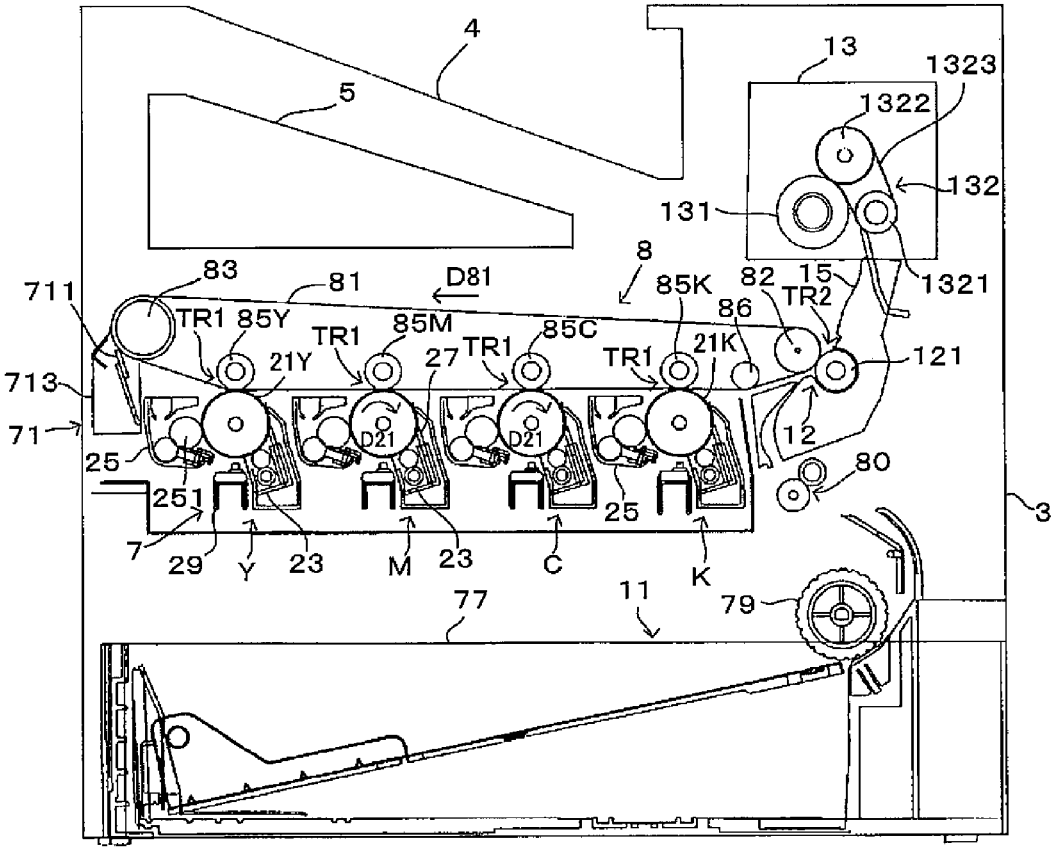
FIG. 1 is a diagram showing an embodiment of an image forming apparatus to which the invention is applicable.
Figure 2:
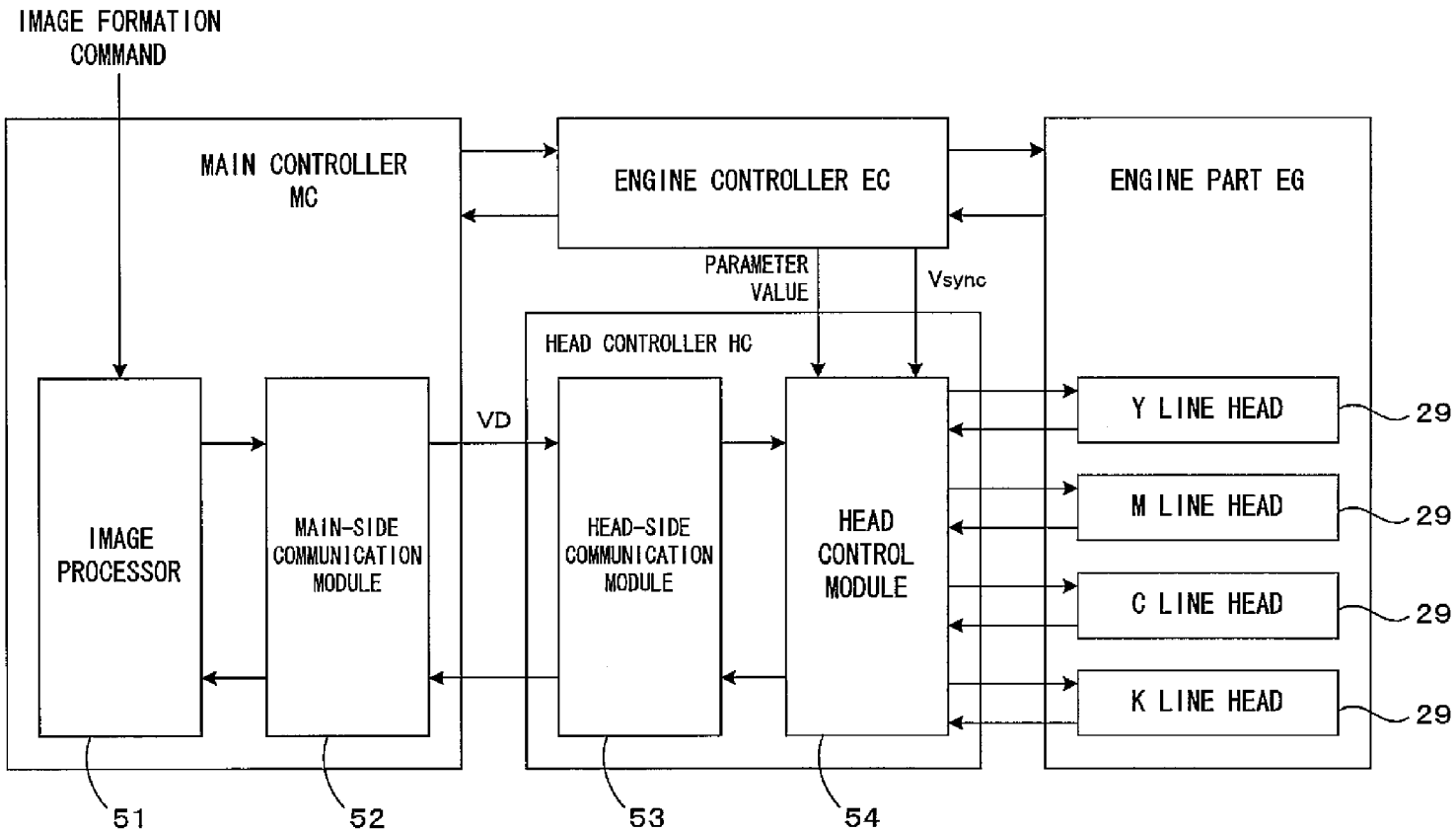
FIG. 2 is a diagram showing the electrical construction of the image forming apparatus of FIG. 1.

FIG. 1 is a diagram showing an embodiment of an image forming apparatus to which the invention is applicable. FIG. 2 is a diagram showing the electrical construction of the image forming apparatus of FIG. 1. This apparatus is an image forming apparatus that can selectively execute a color mode for forming a color image by superimposing four color toners of black (K), cyan (C), magenta (M) and yellow (Y) and a monochromatic mode for forming a monochromatic image using only black (K) toner. In other words, this apparatus is a so-called tandem image forming apparatus. FIG. 1 is a diagram corresponding to the execution of the color mode. In this image forming apparatus, when an image formation command is given from an external apparatus such as a host computer to a main controller MC having a CPU and memories, the main controller MC feeds a control signal and the like to an engine controller EC and feeds video data VD corresponding to the image formation command to a head controller HC. This head controller HC controls line heads 29 of the respective colors based on the video data VD from the main controller MC, a vertical synchronization signal Vsync from the engine controller EC and parameter values from the engine controller EC. In this way, an engine part EG performs a specified image forming operation to form an image corresponding to the image formation command on a sheet such as a copy sheet, transfer sheet, form sheet or transparent sheet for OHP.

An electrical component box 5 having a power supply circuit board, the main controller MC, the engine controller EC and the head controller HC built therein is disposed in a housing main body 3 of the image forming apparatus. An image forming unit 7, a transfer belt unit 8 and a sheet feeding unit 11 are also arranged in the housing main body 3. A secondary transfer unit 12, a fixing unit 13 and a sheet guiding member 15 are arranged at the right side in the housing main body 3 in FIG. 1. It should be noted that the sheet feeding unit 11 is detachably mountable into the housing main body 3. The sheet feeding unit 11 and the transfer belt unit 8 are so constructed as to be detachable for repair or exchange respectively.

The image forming unit 7 includes four image forming stations Y (for yellow), M (for magenta), C (for cyan) and K (for black) which form a plurality of images having different colors. Each of the image forming stations Y, M, C and K includes a cylindrical photosensitive drum 21 having a surface of a specified length in a main scanning direction MD. Each of the image forming stations Y, M, C and K forms a toner image of the corresponding color on the surface of the photosensitive drum 21. The photosensitive drum is arranged so that the axial direction thereof is substantially parallel to the main scanning direction MD. Each photosensitive drum 21 is connected to its own driving motor and is driven to rotate at a specified speed in a direction of arrow D21 in FIG. 1, whereby the surface of the photosensitive drum 21 is transported in a sub scanning direction SD which is orthogonal to or substantially orthogonal to the main scanning direction MD. Further, a charger 23, the line head 29, a developer 25 and a photosensitive drum cleaner 27 are arranged in a rotating direction around each photosensitive drum 21. A charging operation, a latent image forming operation and a toner developing operation are performed by these functional sections. Accordingly, a color image is formed by superimposing toner images formed by all the image forming stations Y, M, C and K on a transfer belt 81 of the transfer belt unit 8 at the time of executing the color mode, and a monochromatic image is formed using only a toner image formed by the image forming station K at the time of executing the monochromatic mode. Meanwhile, since the respective image forming stations of the image forming unit 7 are identically constructed, reference characters are given to only some of the image forming stations while being not given to the other image forming stations in order to facilitate the diagrammatic representation in FIG. 1.

The charger 23 includes a charging roller having the surface thereof made of an elastic rubber. This charging roller is constructed to be rotated by being held in contact with the surface of the photosensitive drum 21 at a charging position. As the photosensitive drum 21 rotates, the charging roller is rotated at the same circumferential speed in a direction driven by the photosensitive drum 21. This charging roller is connected to a charging bias generator (not shown) and charges the surface of the photosensitive drum 21 at the charging position where the charger 23 and the photosensitive drum 21 are in contact upon receiving the supply of a charging bias from the charging bias generator.

The line head 29 is arranged relative to the photosensitive drum 21 so that the longitudinal direction thereof corresponds to the main scanning direction MD and the width direction thereof corresponds to the sub scanning direction SD. Hence, the longitudinal direction of the line head 29 is substantially parallel to the main scanning direction MD. The line head includes a plurality of light emitting elements arrayed in the longitudinal direction and is positioned separated from the photosensitive drum 21. Light beams are emitted from these light emitting elements to irradiate (in other words, expose) the surface of the photosensitive drum 21 charged by the charger 23, thereby forming a latent image on this surface. The head controller HC is provided to control the line heads 29 of the respective colors, and controls the respective line heads 29 based on the video data VD from the main controller MC and a signal from the engine controller EC. Specifically, image data included in an image formation command is inputted to an image processor 51 of the main controller MC. Then, video data VD of the respective colors are generated by applying various image processings to the image data, and the video data VD are fed to the head controller HC via a main-side communication module 52. In the head controller HC, the video data VD are fed to a head control module 54 via a head-side communication module 53. Signals representing parameter values relating to the formation of a latent image and the vertical synchronization signal Vsync are fed to this head control module 54 from the engine controller EC as described above. Based on these signals, the video data VD and the like, the head controller HC generates signals for controlling the driving of the elements of the line heads 29 of the respective colors and outputs them to the respective line heads 29. In this way, the operations of the light emitting elements in the respective line heads 29 are suitably controlled to form latent images corresponding to the image formation command.

The photosensitive drum 21, the charger 23, the developer 25 and the photosensitive drum cleaner 27 of each of the image forming stations Y, M, C and K are unitized as a photosensitive cartridge. Further, each photosensitive cartridge includes a nonvolatile memory for storing information on the photosensitive cartridge. Wireless communication is performed between the engine controller EC and the respective photosensitive cartridges. By doing so, the information on the respective photosensitive cartridges is transmitted to the engine controller EC and information in the respective memories can be updated and stored.

The developer 25 includes a developing roller 251 carrying toner on the surface thereof. By a development bias applied to the developing roller 251 from a development bias generator (not shown) electrically connected to the developing roller 251, charged toner is transferred from the developing roller 251 to the photosensitive drum 21 to develop the latent image formed by the line head 29 at a development position where the developing roller 251 and the photosensitive drum 21 are in contact.

The toner image developed at the development position in this way is primarily transferred to the transfer belt 81 at a primary transfer position TR1 to be described later where the transfer belt 81 and each photosensitive drum 21 are in contact after being transported in the rotating direction D21 of the photosensitive drum 21.

Further, the photosensitive drum cleaner 27 is disposed in contact with the surface of the photosensitive drum 21 downstream of the primary transfer position TR1 and upstream of the charger 23 with respect to the rotating direction D21 of the photosensitive drum 21. This photosensitive drum cleaner 27 removes the toner remaining on the surface of the photosensitive drum 21 to clean after the primary transfer by being held in contact with the surface of the photosensitive drum.

The transfer belt unit 8 includes a driving roller 82, a driven roller (blade facing roller) 83 arranged to the left of the driving roller 82 in FIG. 1, and the transfer belt 81 mounted on these rollers. The transfer belt unit 8 also includes four primary transfer rollers 85Y, 85M, 85C and 85K arranged to face in a one-to-one relationship with the photosensitive drums 21 of the respective image forming stations Y, M, C and K inside the transfer belt 81 when the photosensitive cartridges are mounted. These primary transfer rollers 85Y, 85M, 85C and 85K are respectively electrically connected to a primary transfer bias generator not shown. As described in detail later, at the time of executing the color mode, all the primary transfer rollers 85Y, 85M, 85C and 85K are positioned on the sides of the image forming stations Y, M, C and K as shown in FIG. 1, whereby the transfer belt 81 is pressed into contact with the photosensitive drums 21 of the image forming stations Y, M, C and K to form the primary transfer positions TR1 between the respective photosensitive drums 21 and the transfer belt 81. By applying primary transfer biases from the primary transfer bias generator to the primary transfer rollers 85Y, 85M, 85C and 85K at suitable timings, the toner images formed on the surfaces of the respective photosensitive drums 21 are transferred to the surface of the transfer belt 81 at the corresponding primary transfer positions TR1 to form a color image.

On the other hand, out of the four primary transfer rollers 85Y, 85M, 85C and 85K, the color primary transfer rollers 85Y, 85M, 85C are separated from the facing image forming stations Y, M and C and only the monochromatic primary transfer roller 85K is brought into contact with the image forming station K at the time of executing the monochromatic mode, whereby only the monochromatic image forming station K is brought into contact with the transfer belt 81. As a result, the primary transfer position TR1 is formed only between the monochromatic primary transfer roller 85K and the image forming station K. By applying a primary transfer bias at a suitable timing from the primary transfer bias generator to the monochromatic primary transfer roller 85K, the toner image formed on the surface of the photosensitive drum 21 is transferred to the surface of the transfer belt 81 at the primary transfer position TR1 to form a monochromatic image.

The transfer belt unit 8 further includes a downstream guide roller 86 disposed downstream of the monochromatic primary transfer roller 85K and upstream of the driving roller 82. This downstream guide roller 86 is so disposed as to come into contact with the transfer belt 81 on an internal common tangent to the primary transfer roller 85K and the photosensitive drum 21 at the primary transfer position TR1 formed by the contact of the monochromatic primary transfer roller 85K with the photosensitive drum 21 of the image forming station K.

The driving roller 82 drives to rotate the transfer belt 81 in the direction of the arrow D81 and doubles as a backup roller for a secondary transfer roller 121. A rubber layer having a thickness of about 3 mm and a volume resistivity of 1000 kΩ·cm or lower is formed on the circumferential surface of the driving roller 82 and is grounded via a metal shaft, thereby serving as an electrical conductive path for a secondary transfer bias to be supplied from an unillustrated secondary transfer bias generator via the secondary transfer roller 121. By providing the driving roller 82 with the rubber layer having high friction and shock absorption, an impact caused upon the entrance of a sheet into a contact part (secondary transfer position TR2) of the driving roller 82 and the secondary transfer roller 121 is unlikely to be transmitted to the transfer belt 81 and image deterioration can be prevented.

The sheet feeding unit 11 includes a sheet feeding section which has a sheet cassette 77 capable of holding a stack of sheets, and a pickup roller 79 which feeds the sheets one by one from the sheet cassette 77. The sheet fed from the sheet feeding section by the pickup roller 79 is fed to the secondary transfer position TR2 along the sheet guiding member 15 after having a sheet feed timing adjusted by a pair of registration rollers 80.

The secondary transfer roller 121 is provided freely to abut on and move away from the transfer belt 81, and is driven to abut on and move away from the transfer belt 81 by a secondary transfer roller driving mechanism (not shown). The fixing unit 13 includes a heating roller 131 which is freely rotatable and has a heating element such as a halogen heater built therein, and a pressing section 132 which presses this heating roller 131. The sheet having an image secondarily transferred to the front side thereof is guided by the sheet guiding member 15 to a nip portion formed between the heating roller 131 and a pressure belt 1323 of the pressing section 132, and the image is thermally fixed at a specified temperature in this nip portion. The pressing section 132 includes two rollers 1321 and 1322 and the pressure belt 1323 mounted on these rollers. Out of the surface of the pressure belt 1323, a part stretched by the two rollers 1321 and 1322 is pressed against the circumferential surface of the heating roller 131, thereby forming a sufficiently wide nip portion between the heating roller 131 and the pressure belt 1323. The sheet having been subjected to the image fixing operation in this way is transported to the discharge tray 4 provided on the upper surface of the housing main body 3.

Further, a cleaner 71 is disposed facing the blade facing roller 83 in this apparatus. The cleaner 71 includes a cleaner blade 711 and a waste toner box 713. The cleaner blade 711 removes foreign matters such as toner remaining on the transfer belt after the secondary transfer and paper powder by holding the leading end thereof in contact with the blade facing roller 83 via the transfer belt 81. Foreign matters thus removed are collected into the waste toner box 713. Further, the cleaner blade 711 and the waste toner box 713 are constructed integral to the blade facing roller 83. Accordingly, if the blade facing roller 83 moves as described next, the cleaner blade 711 and the waste toner box 713 move together with the blade facing roller 83.

II. Construction of Line Head

Figure 3:
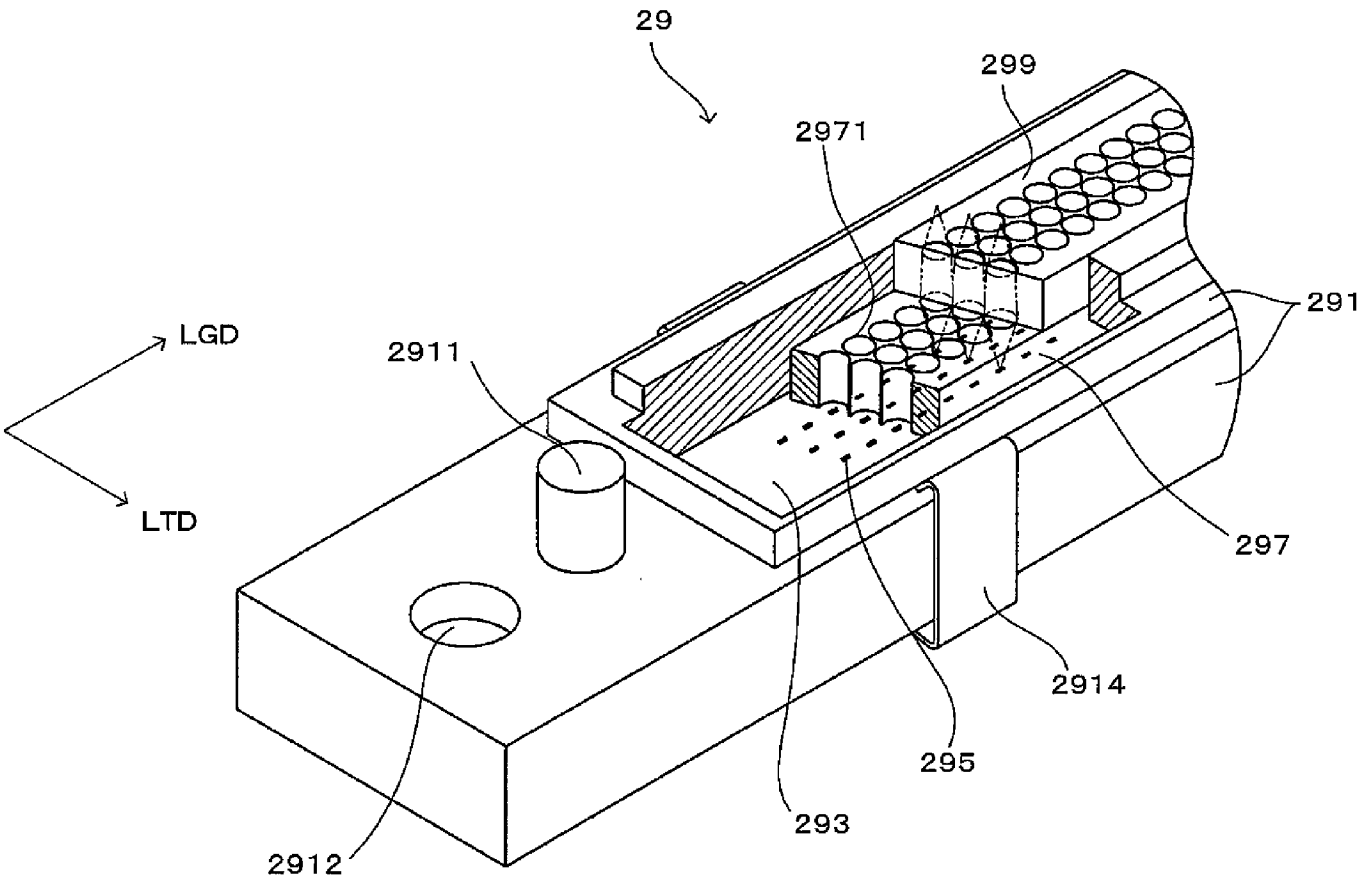
FIG. 3 is a perspective view schematically showing a line head.
Figure 4:
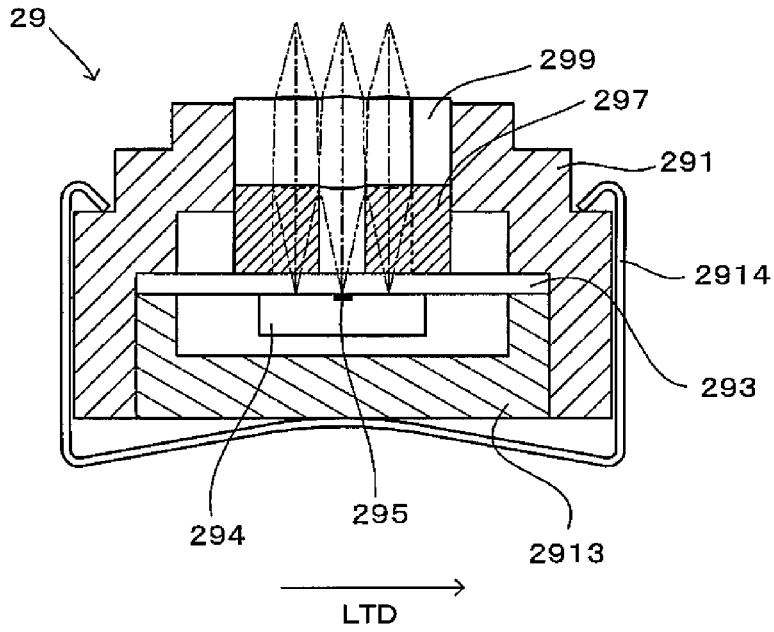
FIG. 4 is a sectional view along a width direction of the line head shown in FIG. 3.

FIG. 3 is a perspective view schematically showing a line head, and FIG. 4 is a sectional view along a width direction of the line head shown in FIG. 3. As described above, the line head 29 is arranged to face the photosensitive drum 21 such that the longitudinal direction LGD corresponds to the main scanning direction MD and the width direction LTD corresponds to the sub scanning direction SD. The longitudinal direction LGD and the width direction LTD are normal to or substantially normal to each other. Hence, the longitudinal direction LGD is parallel to or substantially parallel to the main scanning direction MD while the width direction LTD is parallel to or substantially parallel to the sub scanning direction SD. The line head 29 of this embodiment includes a case 291, and a positioning pin 2911 and a screw insertion hole 2912 are provided at each of the opposite ends of such a case 291 in the longitudinal direction LGD. The line head 29 is positioned relative to the photosensitive drum 21 by fitting such positioning pins 2911 into positioning holes (not shown) perforated in a photosensitive drum cover (not shown) covering the photosensitive drum 21 and positioned relative to the photosensitive drum 21. Further, the line head 29 is positioned and fixed relative to the photosensitive drum 21 by screwing fixing screws into screw holes (not shown) of the photosensitive drum cover via the screw insertion holes 2912 to be fixed.

The case 291 carries a lens array 299 at a position facing the surface of the photosensitive drum 21, and includes a light shielding member 297 and a head substrate 293 inside, the light shielding member 297 being closer to the lens array 299 than the head substrate 293. The head substrate 293 is made of a transmissive material (glass for instance). Further, a plurality of light emitting element groups 295 are provided on an under surface of the head substrate 293 (surface opposite to the lens array 299 out of two surfaces of the head substrate 293). Specifically, the plurality of light emitting element groups 295 are two-dimensionally arranged on the under surface of the head substrate 293 while being spaced by specified distances in the longitudinal direction LGD and the width direction LTD. Here, each light emitting element group 295 is formed by two-dimensionally arraying a plurality of light emitting elements. This will be described in detail later. Bottom emission-type EL (electroluminescence) devices are used as the light emitting elements. In other words, the organic EL devices are arranged as light emitting elements on the under surface of the head substrate 293. Thus, all the light emitting elements 2951 are arranged on the same plane (under surface of the head substrate 293) and emit light beams having the same wavelength. When the respective light emitting elements are driven by a drive circuit formed on the head substrate 293, light beams are emitted from the light emitting elements in directions toward the photosensitive drum 21. These light beams propagate toward the light shielding member 297 after passing through the head substrate 293 from the under surface thereof to a top surface thereof.

The light shielding member 297 is perforated with a plurality of light guide holes 2971 in a one-to-one correspondence with the plurality of light emitting element groups 295. The light guide holes 2971 are substantially cylindrical holes penetrating the light shielding member 297 and having central axes in parallel with normals to the head substrate 293. Accordingly, out of light beams emitted from the light emitting element groups 295, those propagating toward other than the light guide holes 2971 corresponding to the light emitting element groups 295 are shielded by the light shielding member 297. In this way, all the lights emitted from one light emitting element group 295 propagate toward the lens array 299 via the same light guide hole 2971 and the mutual interference of the light beams emitted from different light emitting element groups 295 can be prevented by the light shielding member 297. The light beams having passed through the light guide holes 2971 perforated in the light shielding member 297 are imaged as spots on the surface of the photosensitive drum 21 by the lens array 299.

As described above, in this embodiment, some lights out of lights being emitted from the light emitting elements 2951 pass through the light guide holes 2971 formed in the light shielding member 297. The some lights are incident on the lenses LS and contribute to image formation. In other words, the lights incident on the lenses LS and contributing to image formation are restricted by the light shielding member 297. Accordingly, a problem of disturbing the formed image by stray lights and the like is suppressed by the light shielding member 297, and a detection image such as a registration mark RM to be described later can be satisfactorily formed. By detecting a detection image satisfactorily formed in this way, the detection result on the detection image can be made stable.

As shown in FIG. 4, an underside lid 2913 is pressed against the case 291 via the head substrate 293 by retainers 2914. Specifically, the retainers 2914 have elastic forces to press the underside lid 2913 toward the case 291, and seal the inside of the case 291 light-tight (that is, so that light does not leak from the inside of the case 291 and so that light does not intrude into the case 291 from the outside) by pressing the underside lid by means of the elastic force. It should be noted that a plurality of the retainers 2914 are provided at a plurality of positions in the longitudinal direction of the case 291. The light emitting element groups 295 are covered with a sealing member 294.

Figure 5:
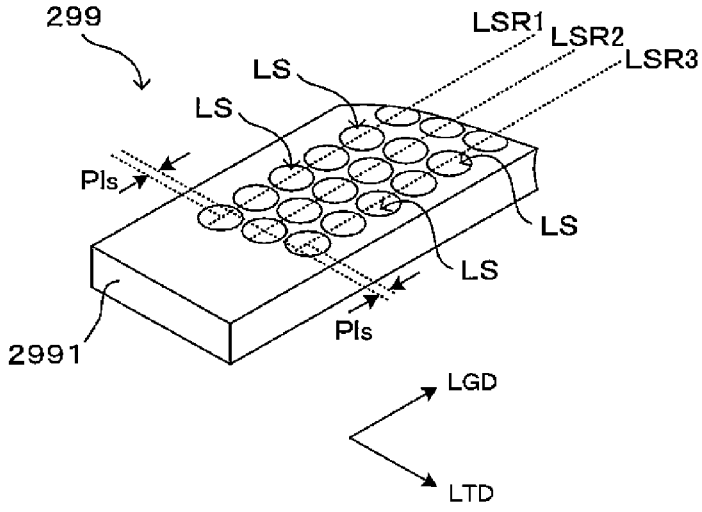
FIG. 5 is a schematic partial perspective view of the lens array.
Figure 6:
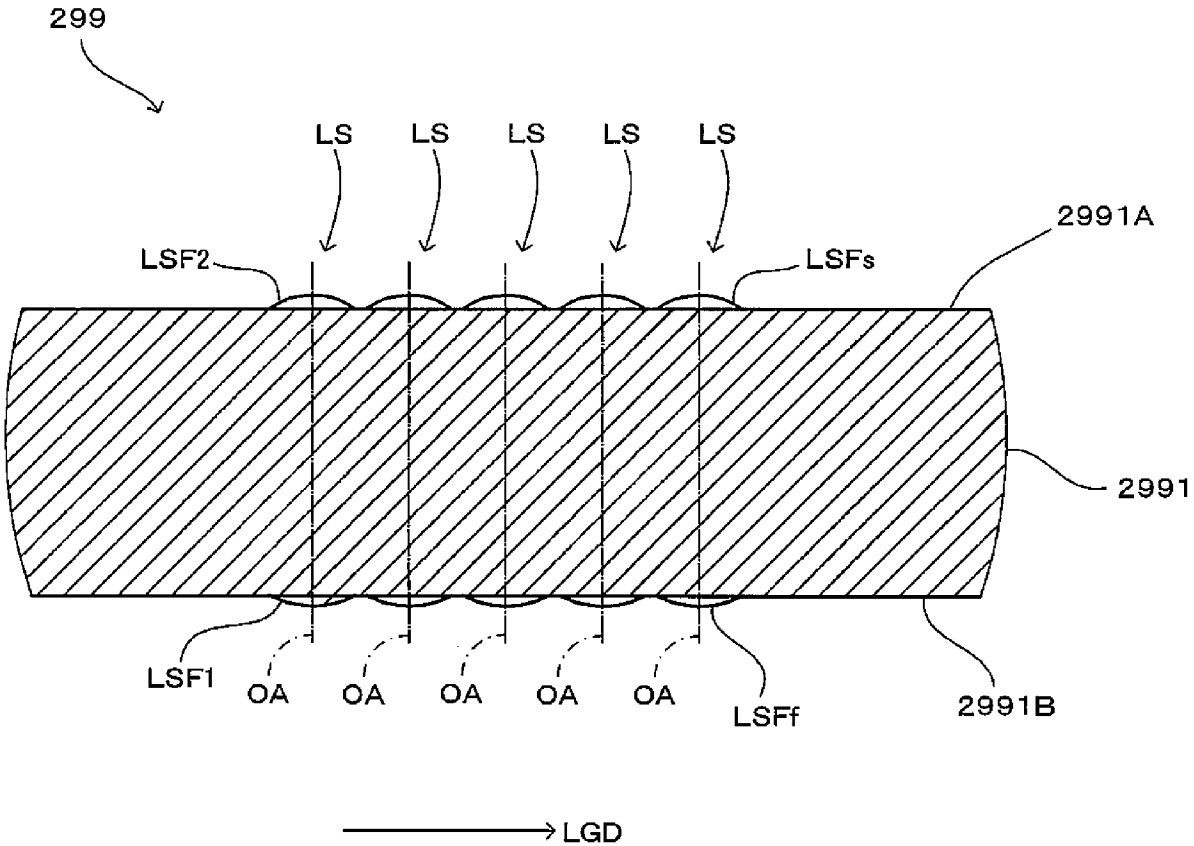
FIG. 6 is a sectional view of the lens array in the longitudinal direction LGD.

FIG. 5 is a schematic partial perspective view of the lens array, and FIG. 6 is a sectional view of the lens array in the longitudinal direction LGD. The lens array 299 includes a lens substrate 2991. First surfaces LSFf of lenses LS are formed on an under surface 2991B of the lens substrate 2991, and second surfaces LSFs of the lenses LS are formed on a top surface 2991A of the lens substrate 2991. The first and second surfaces LSFf, LSFs facing each other and the lens substrate 2991 held between these two surfaces function as one lens LS. The first and second surfaces LSFf, LSFs of the lenses LS can be made of resin for instance.

The lens array 299 is arranged such that optical axes OA of the plurality of lenses LS are substantially parallel to each other. The lens array 299 is also arranged such that the optical axes OA of the lenses LS are substantially normal to the under surface (surface where the light emitting elements 2951 are arranged) of the head substrate 293. At this time, these plurality of lenses LS are arranged in a one-to-one correspondence with the plurality of light emitting element groups 295 to be described later. In other words, the plurality of lenses LS are two-dimensionally arranged at specified intervals in the longitudinal direction LGD and the width direction LTD in correspondence with the arrangement of the light emitting element groups 295 to be described later, and focus the lights from the corresponding light emitting element groups 295 to expose the surface of the photosensitive drum 21. These respective lenses LS are arranged as follows. Specifically, a plurality of lens rows LSR, in each of which a plurality of lenses LS are aligned in the longitudinal direction LGD, are arranged in the width direction LTD. In this embodiment, three lens rows LSR1, LSR2, LSR3 are arranged in the width direction LTD. The three lens rows LSR1 to LSR3 are arranged at specified lens pitches Pls in the longitudinal direction, so that the positions of the respective lenses LS differ in the longitudinal direction LGD. In this way, the respective lenses LS can expose regions mutually different in the main scanning direction MD.

Figure 7:
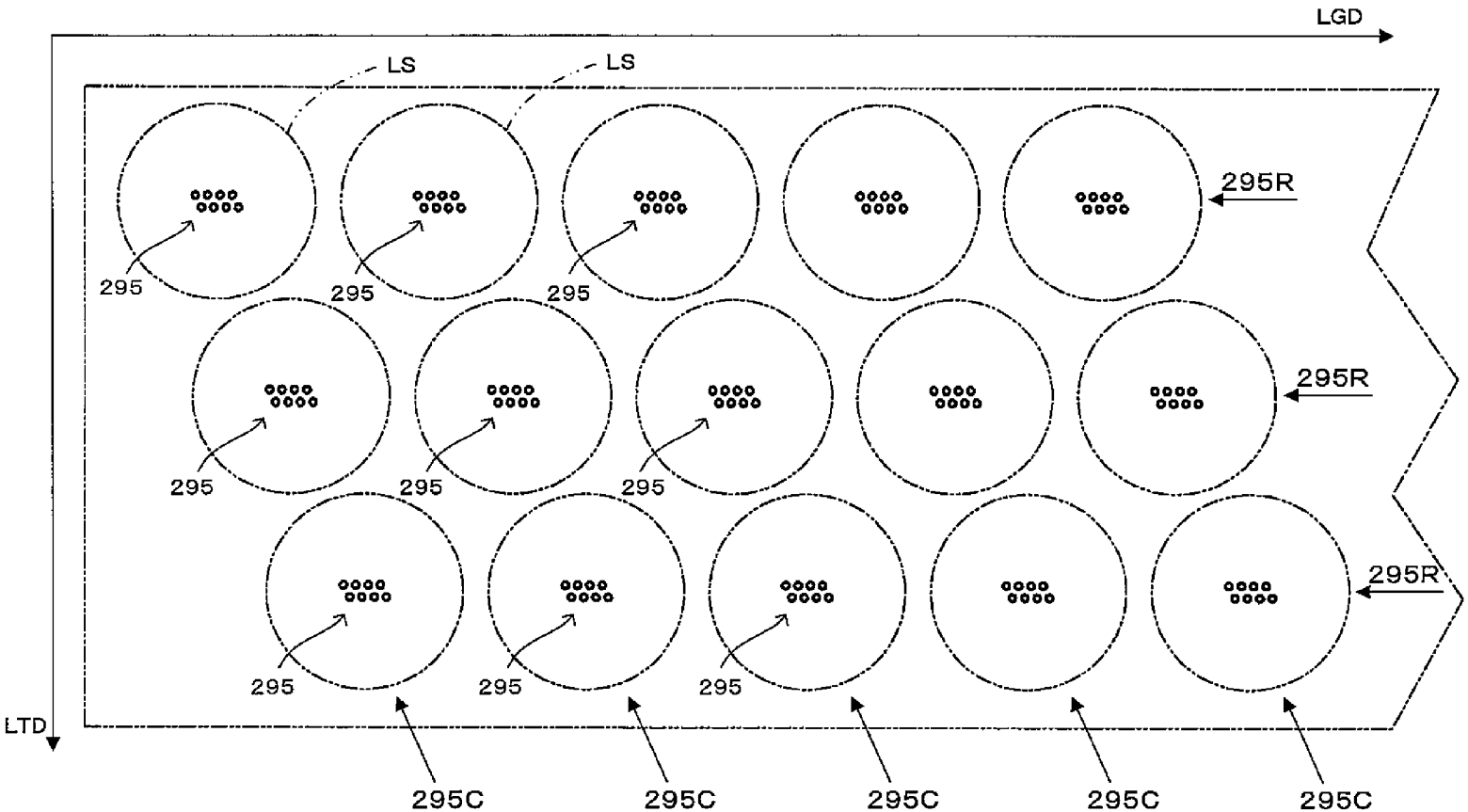
FIG. 7 is a diagram showing the arrangement of the light emitting element groups in the line head.
Figure 8:
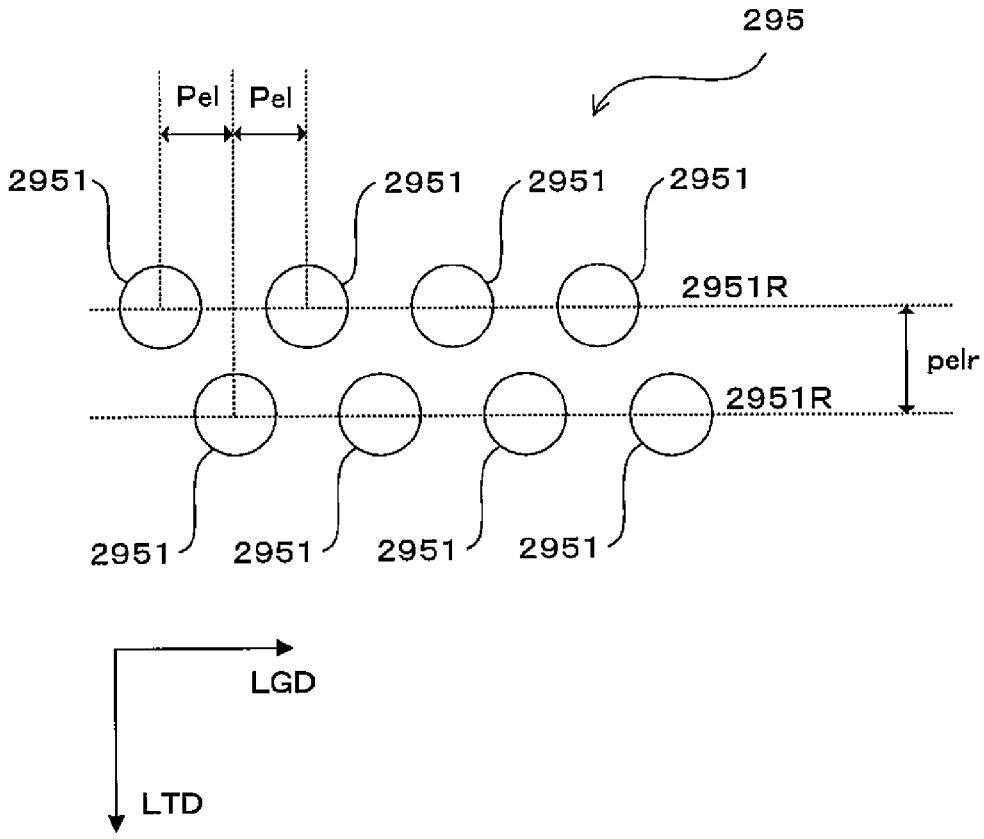
FIG. 8 is a diagram showing the arrangement of the light emitting elements in each light emitting element group.

FIG. 7 is a diagram showing the arrangement of the light emitting element groups in the line head, and FIG. 8 is a diagram showing the arrangement of the light emitting elements in each light emitting element group. The construction of the respective light emitting element groups will be described with reference to FIGS. 7 and 8. Eight light emitting elements 2951 are aligned at specified element pitches Pel in the longitudinal direction LGD in each light emitting element group 295. In each light emitting element group 295, two light emitting element rows 2951R each formed by aligning four light emitting elements 2951 at specified pitches (twice the element pitch Pel) in the longitudinal direction LGD are arranged while being spaced apart by an element row pitch Pelr in the width direction LTD. As a result, eight light emitting elements 2951 are arranged in a staggered manner in each of the light emitting element groups 295. The plurality of light emitting element groups 295 are arranged as follows.

Specifically; a plurality of light emitting element groups 295 are arranged such that a plurality of light emitting element group columns 295C, in each of which three light emitting element groups 295 are offset from each other in the width direction LTD and the longitudinal direction LGD, are arranged in the longitudinal direction LGD. Further, in conformity with such an arrangement of the light emitting element groups, a plurality of lens columns LSC, in each of which three lenses LS are offset from each other in the width direction LTD and the longitudinal direction LGD, are arranged in the longitudinal direction LGD in the lens array 299. The longitudinal-direction positions of the respective light emitting element groups 295 differ from each other, so that the respective light emitting element groups 295 can expose mutually different regions in the main scanning direction MD. A plurality of light emitting element groups 295 arranged in the longitudinal direction LGD (in other words, a plurality of light emitting element groups 295 arranged at the same width-direction position) are particularly defined as a light emitting element group row 295R. In this specification, it is defined that the position of each light emitting element is the geometric center of gravity thereof and that the position of the light emitting element group 295 is the geometric center of gravity of the positions of all the light emitting elements belonging to the same light emitting element group 295. The longitudinal-direction position and the width-direction position mean a longitudinal-direction component and a width-direction component of a particular position, respectively.

The detailed mutual relationship of the light emitting element groups 295, the light guide holes 2971 and the lenses LS is as follows. Specifically, the light guide holes 2971 are perforated in the light shielding member 297 and the lenses LS are arranged in conformity with the arrangement of the light emitting element groups 295. At this time, the center of gravity position of the light emitting element groups 295, the center axes of the light guide holes 2971 and the optical axes OA of the lenses LS substantially coincide. Accordingly, light beams emitted from the light emitting elements 2951 of the light emitting element groups 295 are incident on the lenses LS of the lens array 299 through the light guide holes 2971. Spots are formed on the surface of the photosensitive drum 21 (photosensitive member surface) by imaging these incident light beams by the lenses LS, whereby the photosensitive member surface is exposed. A latent image is formed in the thus exposed part.

III. Terminology in Line Head

Figure 9:
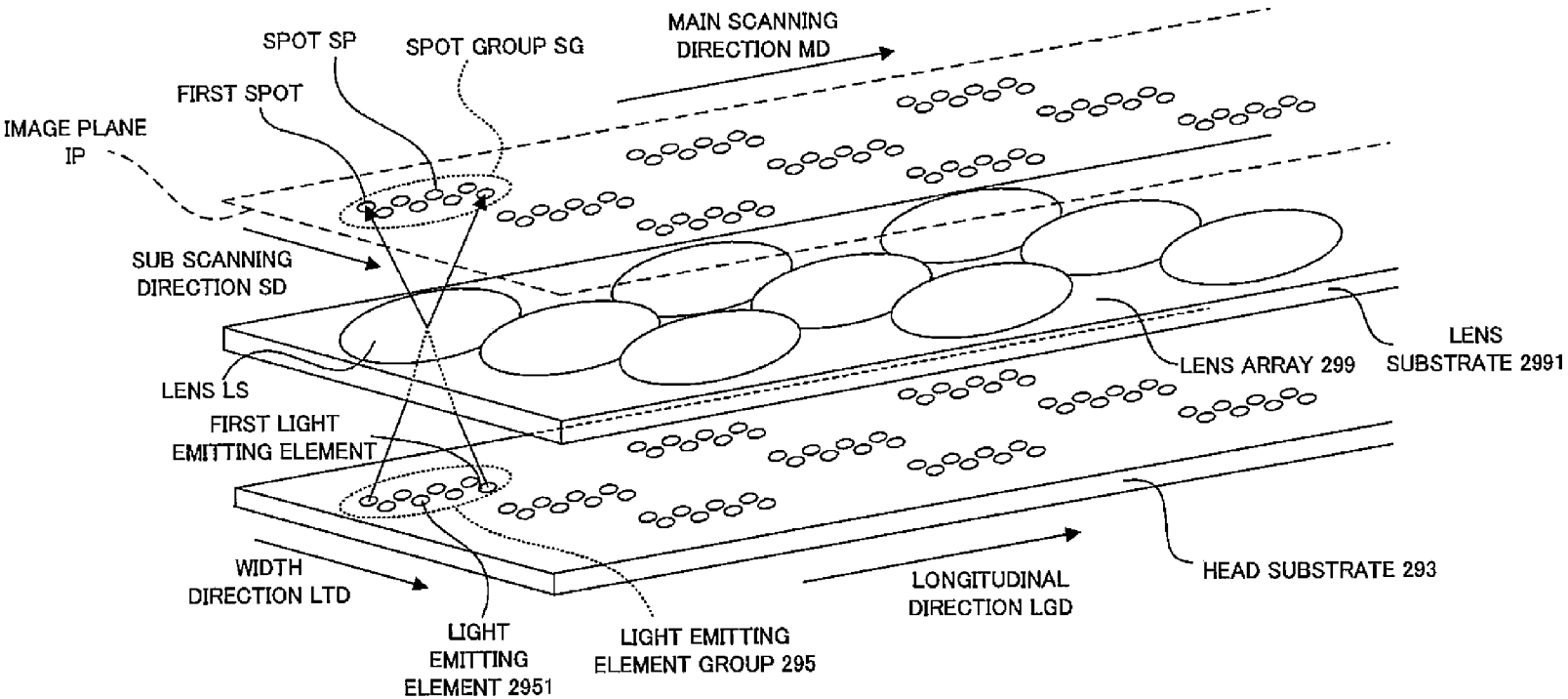
FIGS. 9 and 10 are diagrams showing terminology used in this specification.
Figure 10:
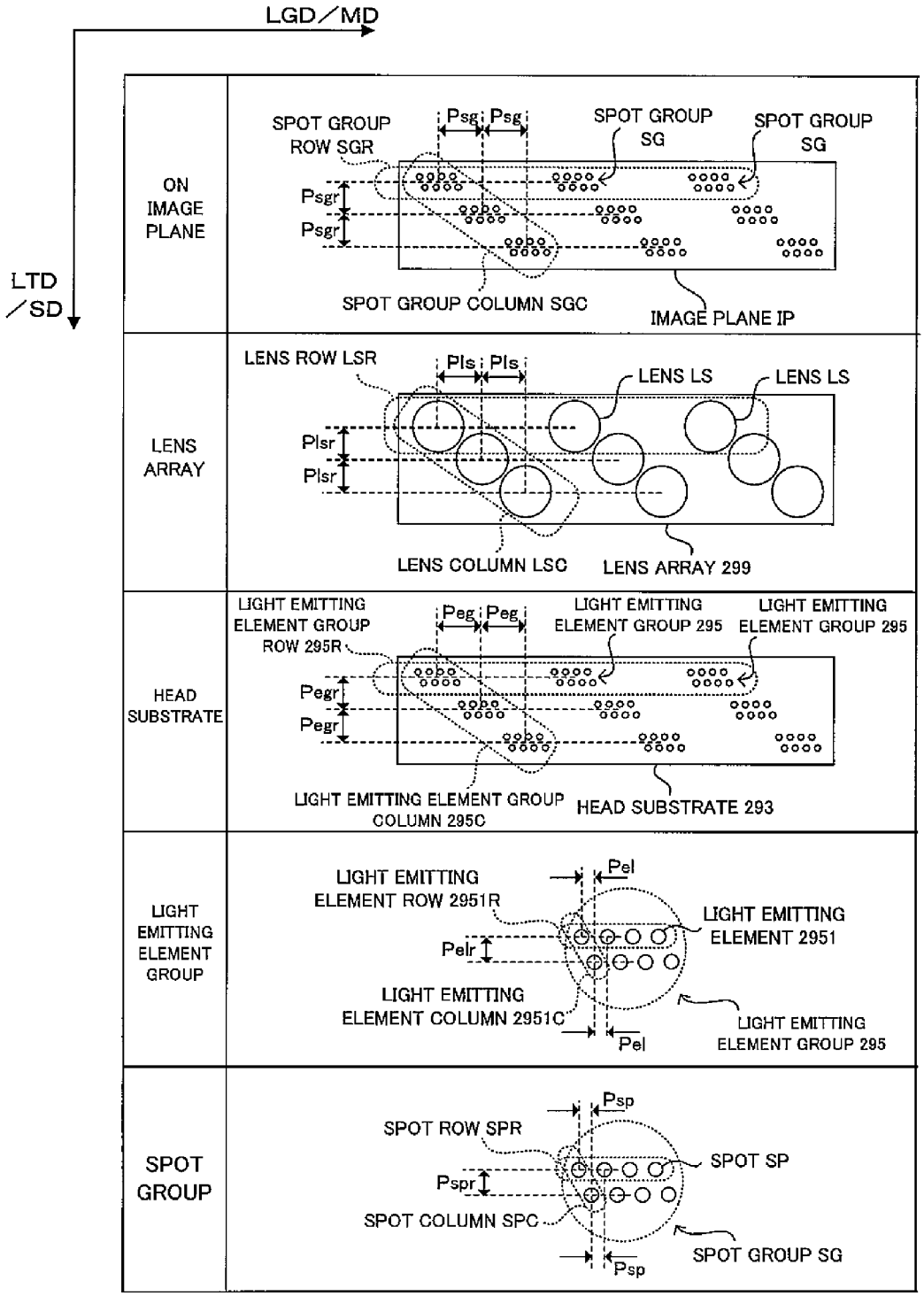

FIGS. 9 and 10 are diagrams showing terminology used in this specification. Here, terminology used in this specification is organized with reference to FIGS. 9 and 10. In this specification, as described above, a conveying direction of the surface (image plane IP) of the photosensitive drum 21 is defined to be the sub scanning direction SD and a direction substantially normal to the sub scanning direction SD is defined to be the main scanning direction MD. Further, a line head 29 is arranged relative to the surface (image plane IP) of the photosensitive drum 21 such that its longitudinal direction LGD corresponds to the main scanning direction MD and its width direction LTD corresponds to the sub scanning direction SD.

Collections of a plurality of (eight in FIGS. 9 and 10) light emitting elements 2951 arranged on the head substrate 293 in one-to-one correspondence with the plurality of lenses LS of the lens array 299 are defined to be light emitting element groups 295. In other words, in the head substrate 293, the plurality of light emitting element groups 295 including a plurality of light emitting elements 2951 are arranged in conformity with the plurality of lenses LS, respectively. Further, collections of a plurality of spots SP formed on the image plane IP by imaging light beams from the light emitting element groups 295 toward the image plane IP by the lenses LS corresponding to the light emitting element groups 295 are defined to be spot groups SG. In other words, a plurality of spot groups SG can be formed in one-to-one correspondence with the plurality of light emitting element groups 295. In each spot group SG, the most upstream spot in the main scanning direction MD and the sub scanning direction SD is particularly defined to be a first spot. The light emitting element 2951 corresponding to the first spot is particularly defined to be a first light emitting element. The lens LS has a negative optical magnification and forms the spot group SG by inverting light beams from the corresponding light emitting element group 295.

Further, spot group rows SGR and spot group columns SGC are defined as shown in the column "On Image Plane" of FIG. 10. Specifically, a plurality of spot groups SG aligned in the main scanning direction MD is defined to be the spot group row SGR. A plurality of spot group rows SGR are arranged at specified spot group row pitches Psgr in the sub scanning direction SD. Further, a plurality of (three in FIG. 10) spot groups SG arranged at the spot group row pitches Psgr in the sub scanning direction SD and at spot group pitches Psg in the main scanning direction MD are defined to be the spot group column SGC. It should be noted that the spot group row pitch Psgr is a distance in the sub scanning direction SD between the geometric centers of gravity of the two spot group rows SGR side by side with the same pitch and that the spot group pitch Psg is a distance in the main scanning direction MD between the geometric centers of gravity of the two spot groups SG side by side with the same pitch.

Lens rows LSR and lens columns LSC are defined as shown in the column of "Lens Array" of FIG. 10. Specifically, a plurality of lenses LS aligned in the longitudinal direction LGD is defined to be the lens row LSR. A plurality of lens rows LSR are arranged at specified lens row pitches Plsr in the width direction LTD. Further, a plurality of (three in FIG. 10) lenses LS arranged at the lens row pitches Plsr in the width direction LTD and at lens pitches Pls in the longitudinal direction LGD are defined to be the lens column LSC. It should be noted that the lens row pitch Plsr is a distance in the width direction LTD between the geometric centers of gravity of the two lens rows LSR side by side with the same pitch and that the lens pitch Pls is a distance in the longitudinal direction LGD between the geometric centers of gravity of the two lenses LS side by side with the same pitch.

Light emitting element group rows 295R and light emitting element group columns 295C are defined as in the column "Head Substrate" of FIG. 10. Specifically, a plurality of light emitting element groups 295 aligned in the longitudinal direction LGD is defined to be the light emitting element group row 295R. A plurality of light emitting element group rows 295R are arranged at specified light emitting element group row pitches Pegr in the width direction LTD. Further, a plurality of (three in FIG. 10) light emitting element groups 295 arranged at the light emitting element group row pitches Pegr in the width direction LTD and at light emitting element group pitches Peg in the longitudinal direction LGD are defined to be the light emitting element group column 295C. It should be noted that the light emitting element group row pitch Pegr is a distance in the width direction LTD between the geometric centers of gravity of the two light emitting element group rows 295R side by side with the same pitch and that the light emitting element group pitch Peg is a distance in the longitudinal direction LGD between the geometric centers of gravity of the two light emitting element groups 295 side by side with the same pitch.

Light emitting element rows 2951R and light emitting element columns 2951C are defined as in the column "Light emitting element Group" of FIG. 10. Specifically, in each light emitting element group 295, a plurality of light emitting elements 2951 aligned in the longitudinal direction LGD is defined to be the light emitting element row 2951R. A plurality of light emitting element rows 2951R are arranged at specified light emitting element row pitches Pelr in the width direction LTD. Further, a plurality of (two in FIG. 10) light emitting elements 2951 arranged at the light emitting element row pitches Pelr in the width direction LTD and at light emitting element pitches Pel in the longitudinal direction LGD are defined to be the light emitting element column 2951C. It should be noted that the light emitting element row pitch Pelr is a distance in the width direction LTD between the geometric centers of gravity of the two light emitting element rows 2951R side by side with the same pitch and that the light emitting element pitch Pel is a distance in the longitudinal direction LGD between the geometric centers of gravity of the two light emitting elements 2951 side by side with the same pitch.

Spot rows SPR and spot columns SPC are defined as shown in the column "Spot Group" of FIG. 10. Specifically, in each spot group SG, a plurality of spots SG aligned in the longitudinal direction LGD is defined to be the spot row SPR. A plurality of spot rows SPR are arranged at specified spot row pitches Pspr in the width direction LTD. Further, a plurality of (two in FIG. 10) spots arranged at the spot row pitches Pspr in the width direction LTD and at spot pitches Psp in the longitudinal direction LGD are defined to be the spot column SPC. It should be noted that the spot row pitch Pspr is a distance in the sub scanning direction SD between the geometric centers of gravity of the two spot rows SPR side by side with the same pitch and that the spot pitch Psp is a distance in the main scanning direction MD between the geometric centers of gravity of the two spots SP side by side with the same pitch.

IV. Exposure Operation by Line Head

Figure 11:
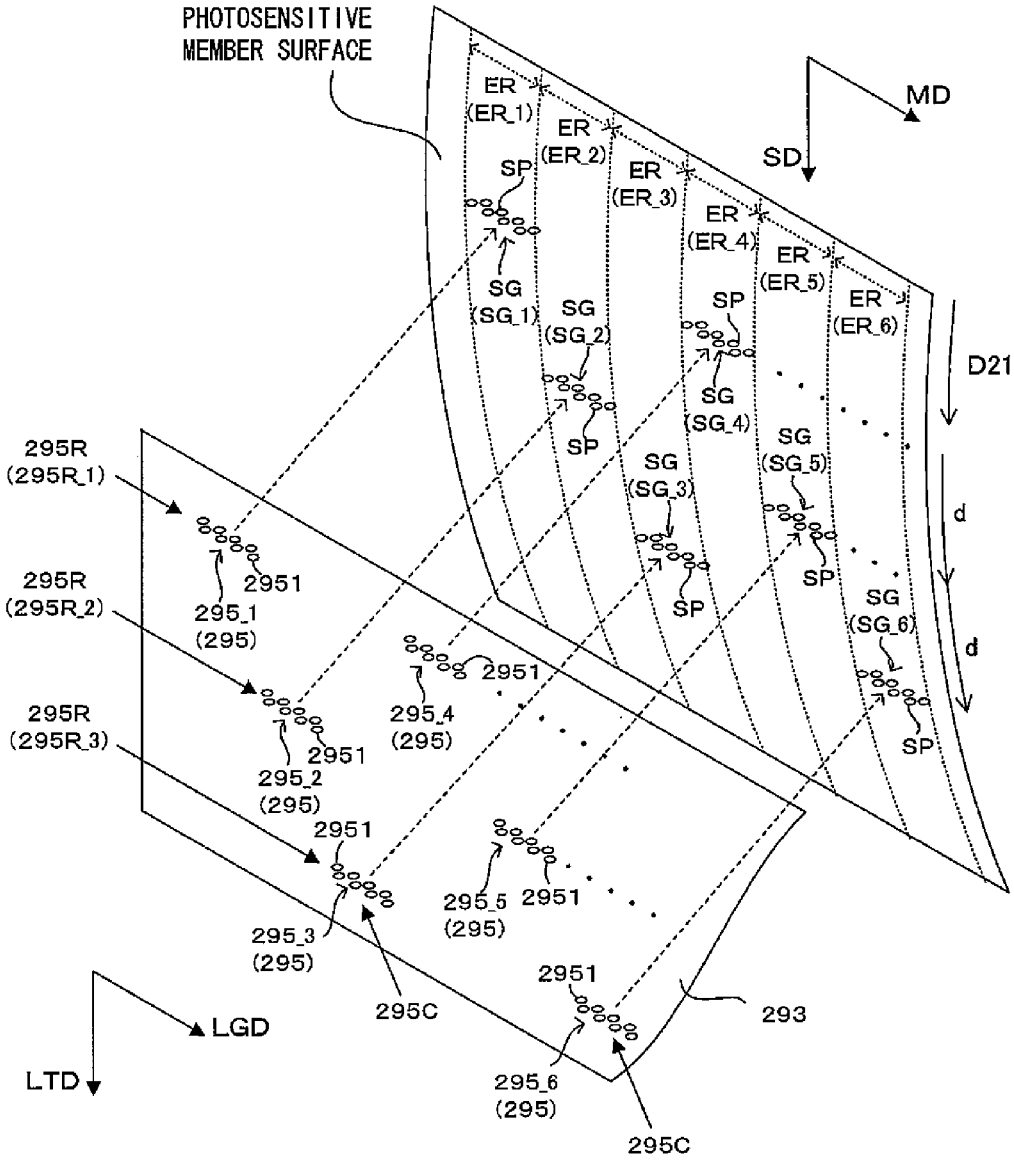
FIG. 11 is a perspective view showing an exposure operation by the line head.

FIG. 11 is a perspective view showing an exposure operation by the line head. As described above, the exposure operation is performed by the lenses LS imaging the lights from the light emitting element groups 295. In FIG. 11, the lens array is not shown. The spot groups SG described next are formed on the photosensitive member surface by imaging the lights from the light emitting element groups 295 by the lenses LS.

However, in the following description, the imaging operations of the lenses LS are omitted if necessary and it is merely described that "the light emitting element groups 295 form the spot groups SG" in order to facilitate the understanding of the exposure operation. As shown in FIG. 11, the respective light emitting element groups 295 can expose mutually different regions ER (ER1 to ER6). For example, the light emitting element group 295_1 forms the spot group SG_1 on the photosensitive member surface moving in the sub scanning direction SD (moving direction D21) by emitting light beams from the respective light emitting elements 2951. In this way, the light emitting element group 2951_1 can expose the region ER_1 of a specified width in the main scanning direction MD. Similarly, the light emitting element groups 295_2 to 295_6 can exposure the regions ER_2 to ER_6.

In the line head 29, the light emitting element group column 295C is formed by offsetting three light emitting element groups 295 from each other in the width direction LTD and the longitudinal direction LGD. For example, as shown in FIG. 11, the light emitting element groups 295_1 to 295_3 constituting the light emitting element group column 295C are offset from each other in the width direction LTD. The three light emitting element groups 295 constituting the light emitting element group column 295C expose three consecutive exposure regions ER in the main scanning direction MD. In this way, the light emitting element group column 295C is formed by offsetting the light emitting element groups 295, which expose the three consecutive exposure regions ER in the main scanning direction MD, from each other in the width direction LTD. The positions of the spot groups SG formed by the light emitting element groups 295 also differ in the sub scanning direction SD in conformity with the offset arrangement of the light emitting element groups 295 in the width direction LTD.

Figure 12:
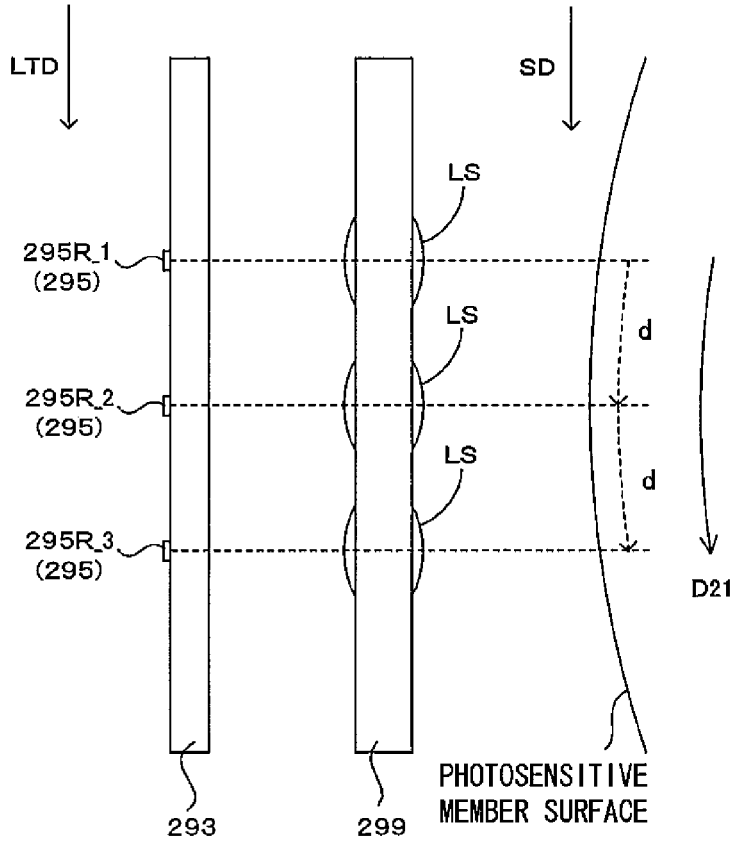
FIG. 12 is a side view showing the exposure operation by the line head.

FIG. 12 is a side view showing the exposure operation by the line head. The exposure operation by the line head will be described with reference to FIGS. 11 and 12. As shown in FIGS. 11 and 12, the light emitting element groups 295 belonging to the same light emitting element group row 295R form the spot groups SG substantially at the same positions in the sub scanning direction SD (moving direction D21). On the other hand, the light emitting element groups belonging to the mutually different light emitting element group rows 295R form the spot groups SG at mutually different positions in the sub scanning direction SD (moving direction D21). In other words, the first light emitting element group row 295R_1 in the width direction LTD forms the spot groups SG_1, SG_4 at most upstream positions in the sub scanning direction SD. The second light emitting element group row 295R_2 forms the spot groups SG_2, SG_5 at positions downstream of these spot groups SG_1 SG_4 by a distance d. Further, the third light emitting element group row 295R_3 forms the spot groups SG_3, SG_6 at positions downstream of these spot groups SG_2, SG_5 by the distance d.

The formation positions of the spot groups SG in the sub scanning direction SD differ depending on the light emitting element groups 295. Accordingly, the respective light emitting element group rows 295R emit lights at mutually different timings to form the spot groups SG, for example, in the case of forming a latent image extending in the main scanning direction MD.

Figure 13:
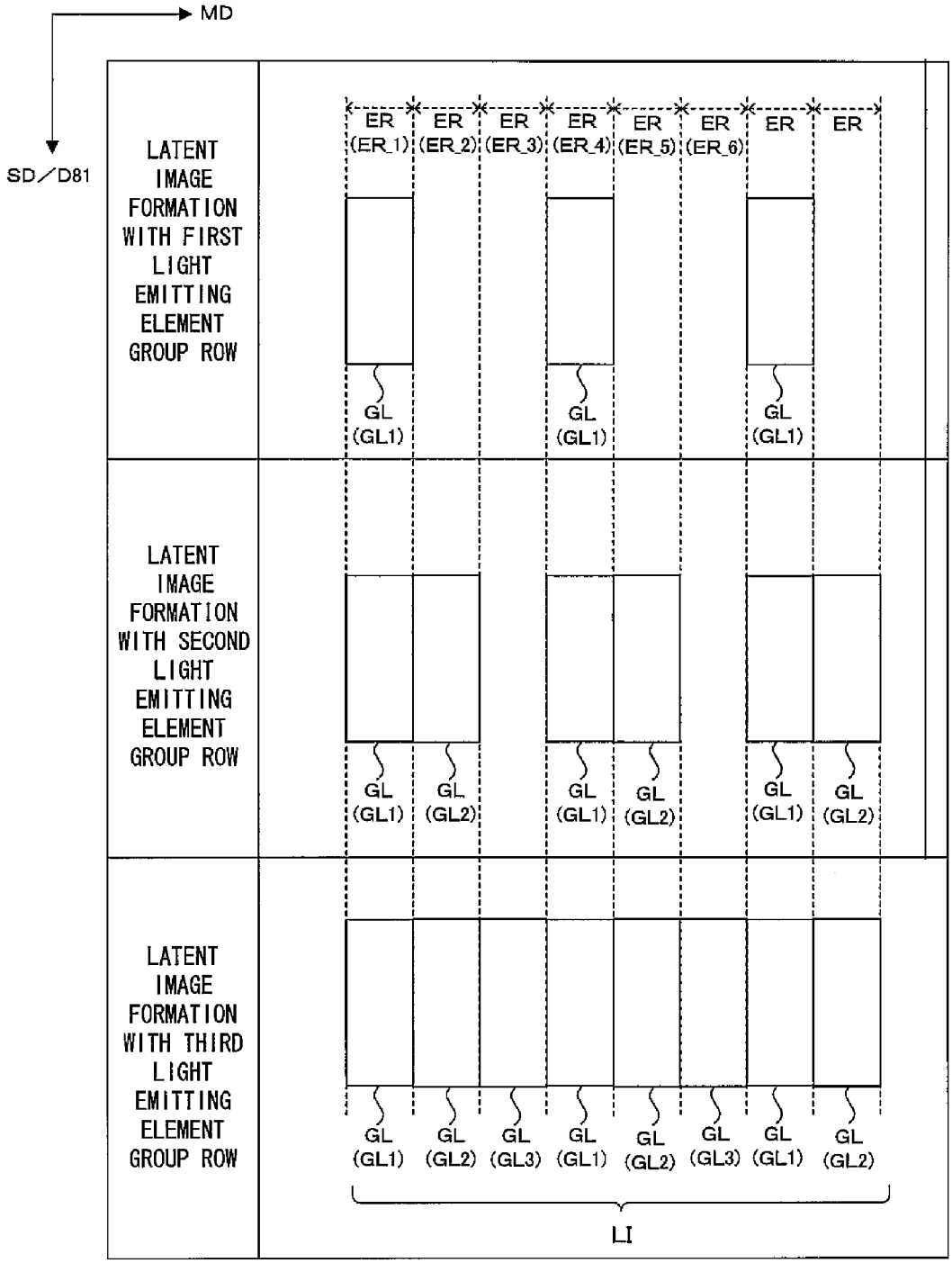
FIG. 13 is a diagram showing an example of a latent image forming operation by the line head.

FIG. 13 is a diagram showing an example of a latent image forming operation by the line head. The example of the latent image forming operation by the line head will be described below with reference to FIGS. 11 to 13. First of all, the first light emitting element group row 295R_1 forms the spot groups SG for a specified period. Thus, group latent images GL1 of a specified width are formed in the regions ER_1, ER_4, . . . in the sub scanning direction SD. Here, the group latent image GL is a latent image formed by one light emitting element group 295. Subsequently, the second light emitting element group row 295R_2 forms the spot groups SG for the specified period at a timing at which the group latent images GL1 formed by the light emitting element group row 295R_1 are conveyed in the sub scanning direction SD by the distance d. Thus, group latent images GL2 of the specified width are formed in the regions ER_2, ER_5, . . . in the sub scanning direction SD. Further, the third light emitting element group row 295R_3 forms the spot groups SG for the specified period at a timing at which the latent images formed by the light emitting element group rows 295R_1, 295R_2 are conveyed in the sub scanning direction SD by the distance d. Thus, group latent images GL3 of the specified width are formed in the regions ER_3, ER_6, . . . in the sub scanning direction SD. In this specification, the group latent images formed by the light emitting element group row 295R_1 (in other words, by the lens row LSR1) are called group latent image GL1 and group toner images obtained by developing the group latent images GL1 are called group toner images GM1. Further, the group latent images formed by the light emitting element group row 295R_2 (in other words, by the lens row LSR2) are called group latent image GL2 and group toner images obtained by developing the group latent images GL2 are called group toner images GM2. Furthermore, the group latent images formed by the light emitting element group row 295R_3 (in other words, by the lens row LSR3) are called group latent image GL3 and group toner images obtained by developing the group latent images GL3 are called group toner images GM3.

Figure 14:
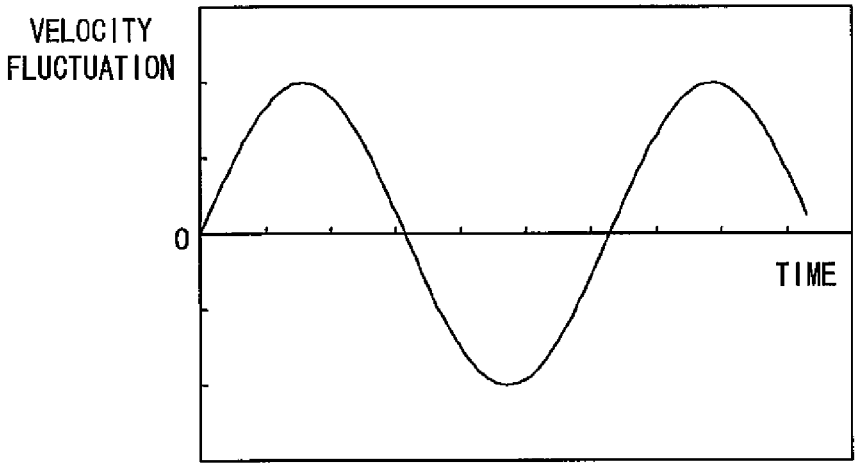
FIG. 14 is a graph showing a relationship between the speed variation of the moving speed of the photosensitive member surface and time.

The respective light emitting element group rows 295R emit lights at different timings in this way, whereby a plurality of group latent images GL1 to GL3 are consecutively formed in the main scanning direction MD to form a latent image LI extending in the main scanning direction MD. However, a moving speed of the photosensitive member surface may vary, for example, as shown in FIG. 14 in some cases due to the eccentricity of the photosensitive drum or the like. FIG. 14 is a graph showing a relationship between the speed variation of the moving speed of the photosensitive member surface and time. As a result, the positions of the group latent images GL1 to GL3 formed by the respective light emitting element groups 295 may vary in the sub scanning direction SD in some cases.

Figure 15:
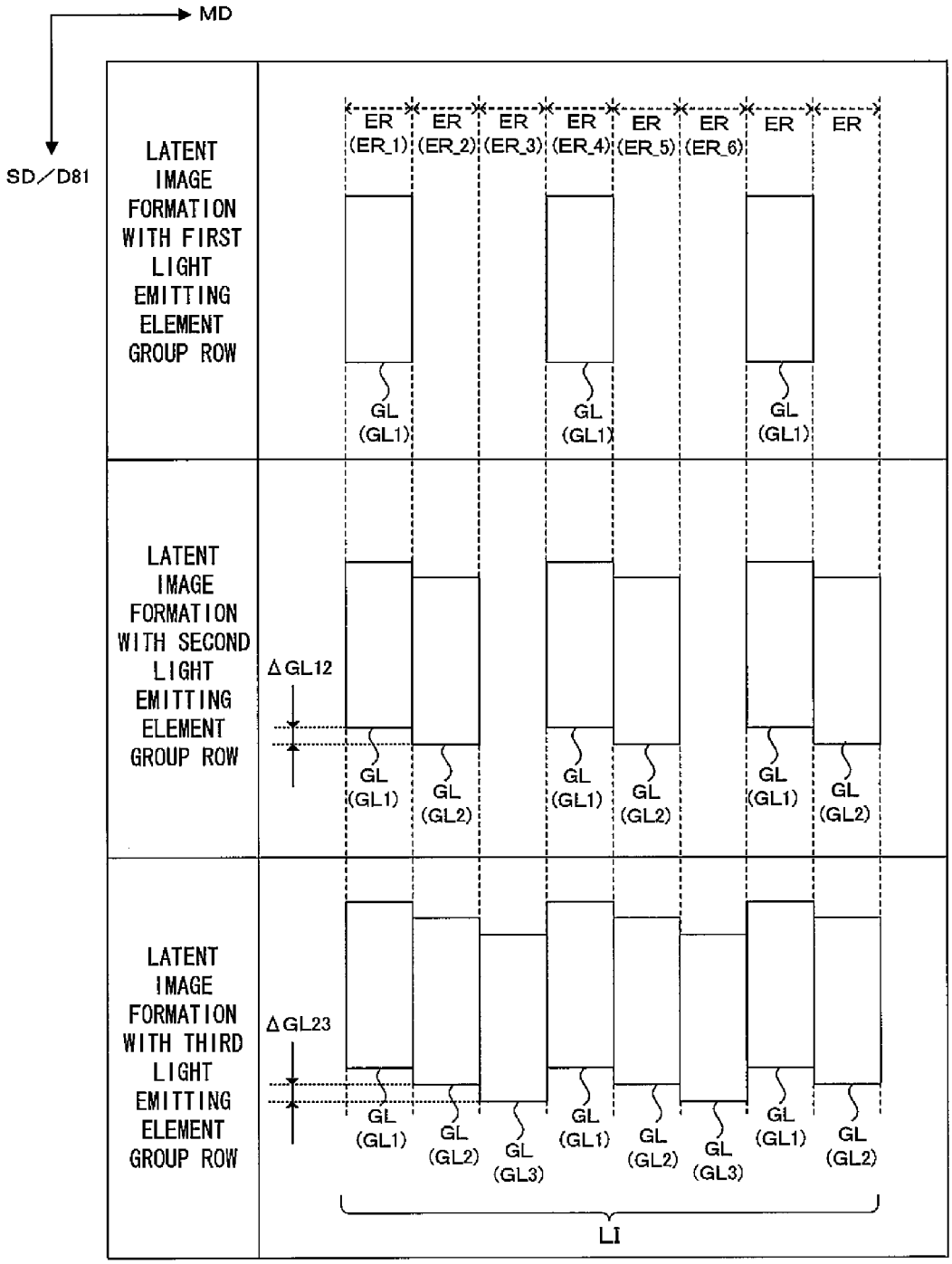
FIG. 15 is a diagram showing positional variations, which can occur in a latent image.

FIG. 15 is a diagram showing positional variations, which can occur in a latent image. As in the case shown in FIG. 13, the first light emitting element group row 295R_1 first forms the spot groups SG for the specified period to form the group latent images GL1. Subsequently, the second light emitting element group row 295R_2 forms the spot groups SG for the specified period to form the group latent images GL2. At this time, the group latent images GL2 are formed while being displaced from the group latent images GL1 by a distance ΔGL12 in the sub scanning direction SD due to the variation of the moving speed of the photosensitive member surface. Further, the third light emitting element group row 295R_3 forms the spot groups SG for the specified period to form the group latent images GL3. In this case as well, the group latent images GL3 are formed while being displaced from the group latent images GL2 by a distance ΔGL23 in the sub scanning direction SD due to the variation of the moving speed of the photosensitive member surface. In this way, the formation positions of the group latent images GL1 to GL3 may vary for the respective light emitting element groups in some cases due to the moving speed variation of the photosensitive member surface. If such positional variations of the latent images occur for the respective light emitting element groups in this way, there are cases where a color misregistration correcting operation to be described next cannot be performed suitably.

V. Color Misregistration Correction Operation

A color misregistration correction operation performed by the image forming apparatus 1 will be described. Specifically, as described above, the image forming apparatus 1 forms a color image by transferring toner images of four colors in such a manner as to superimpose them on the surface of the transfer belt 81. However, in such an image forming apparatus, transfer positions on the transfer belt 81 may be displaced for the respective colors in some cases. Such a displacement appears as a color variation (color misregistration). Accordingly, the image forming apparatus 1 performs a color misregistration correction operation to satisfactorily form a color image.

Figure 16:
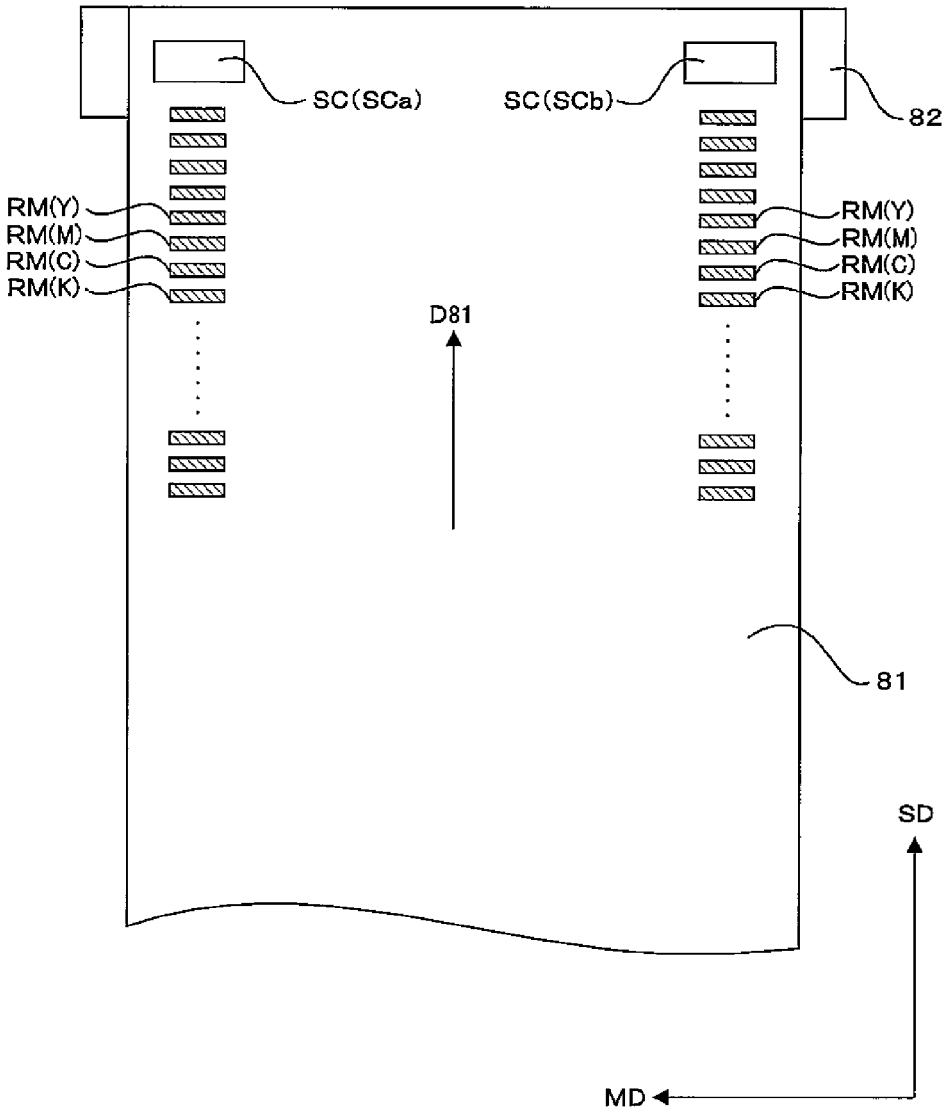
FIG. 16 is a diagram showing a construction for performing the color misregistration correction operation.

FIG. 16 is a diagram showing a construction for performing the color misregistration correction operation, and this diagram corresponds to a case when viewed vertically from below (from the lower side in FIG. 1). This color misregistration correction operation is performed using optical sensors SC. Specifically, two optical sensors SCa, SCb are arranged to face a mounted portion of the transfer belt 81 on the driving roller 82. As shown in FIG. 16, the respective optical sensors SCa, SCb are disposed at an end in the main scanning direction MD.

Figure 17:
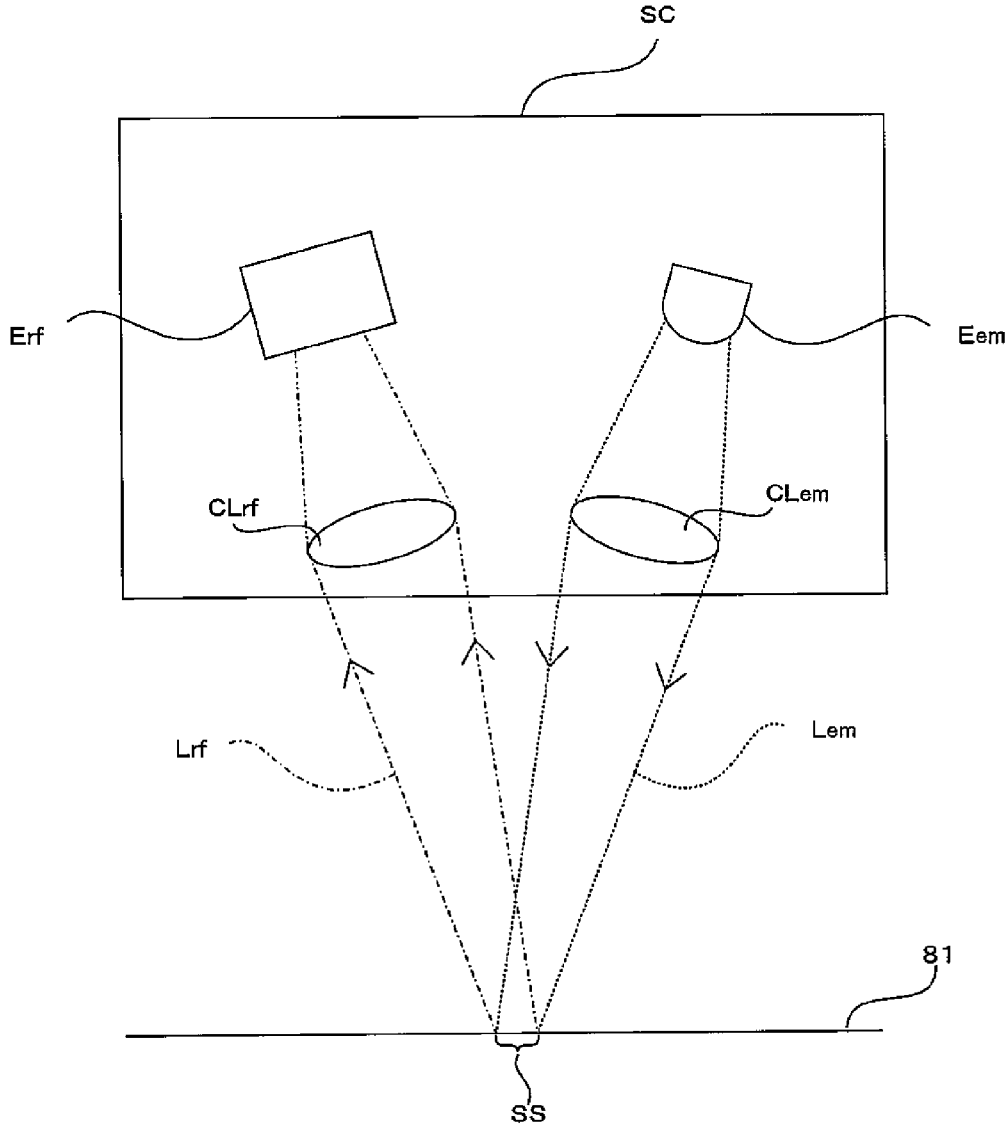
FIG. 17 is a diagram showing an example of the optical sensor.

FIG. 17 is a diagram showing an example of the optical sensor The optical sensor SC includes a light emitter Eem for emitting an irradiated light Lem toward the surface of the transfer belt 81 and a light receiver Erf for receiving a reflected light Lrf reflected by the transfer belt 81. The optical sensor SC further includes a condenser lens CLem for condensing the irradiated light Lem emitted from the light emitter Eem and a condenser lens CLrf for condensing the reflected light Lrf reflected by the surface of the transfer belt 81. Accordingly, the irradiated light Lem emitted from the light emitter Eem is condensed on the surface of the transfer belt 81 by the condenser lens CLem. Thus, a sensor spot SS is formed on the surface of the transfer belt 81. The reflected light Lrf reflected in an area of the sensor spot SS is condensed by the condenser lens CLrf to be detected by the light receiver Erf. In this way, the optical sensor SC detects an object on the sensor spot SS. Various optical sensors conventionally proposed can be used as the optical sensor SC. So-called distance limited reflective photoelectric sensors BGS (Back Ground Suppression) and the like may be used. Such BGSs include, for example, E3Z-LL61-F805M produced by Omron Corporation. This BGS detects an object located inside the sensor spot by projecting a light beam as a sensor spot.

Figure 18:
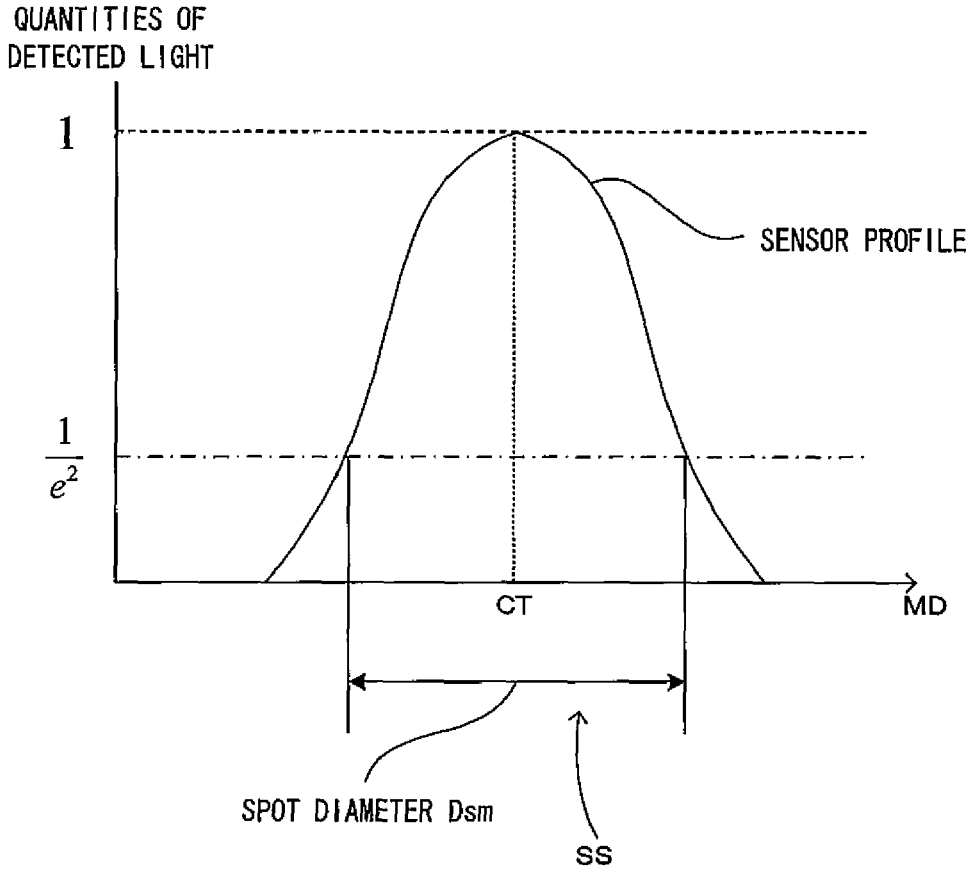
FIG. 18 is a graph of a sensor spot.

FIG. 18 is a graph of a sensor spot. An abscissa of FIG. 18 represents positions in the main scanning direction MD on the surface of the transfer belt 81. An ordinate of FIG. 18 represents the quantities of lights received (detected) by the light receiver Erf out of the reflected lights reflected at the positions represented by the abscissa on the surface of the transfer belt 81. If the quantities detected by the light receiver Erf out of the reflected lights at these positions are plotted with respect to the positions on the surface of the transfer belt 81, a sensor profile shown in FIG. 18 can be obtained. This sensor profile has a substantially laterally symmetrical distribution peaked at a profile center CT. The sensor spot SS is a range where the detected light quantity is equal to or above $1/e^2$ (e is a base of natural logarithm) in the case of normalizing the sensor profile with a peak value set at 1. Accordingly, a spot diameter Dsm in the main scanning direction of the sensor spot SS corresponds to the length indicated by arrows in FIG. 18. As described above, in this embodiment, the sensor spot SS (detection area) is not determined by the light quantity distribution on the surface of the transfer belt 81, but by a detected light quantity distribution on the light receiver Erf. Although the sensor spot SS is described with respect to the main scanning direction MD here, the content of the sensor spot SS is similar also in the sub scanning direction SD.

Referring back to FIG. 16, the description of the color misregistration correction operation is continued. In the color misregistration correction operation, registration marks RM of the respective toner colors are formed (FIG. 16). Specifically, the image forming stations Y, M, C and K form test latent images on the surfaces of the corresponding photosensitive drums 21 and develop these test images in the respective toner colors to form the registration marks RM(Y), RM(M), RM(C) and RM(K) as the test images. These registration marks RM are transferred to be arranged in a conveying direction D81 on the surface of the transfer belt 81. The registration marks RM thus formed on the transfer belt 81 are conveyed in the conveying direction D81 and detected by the optical sensors SC (detecting step).

Figure 19:
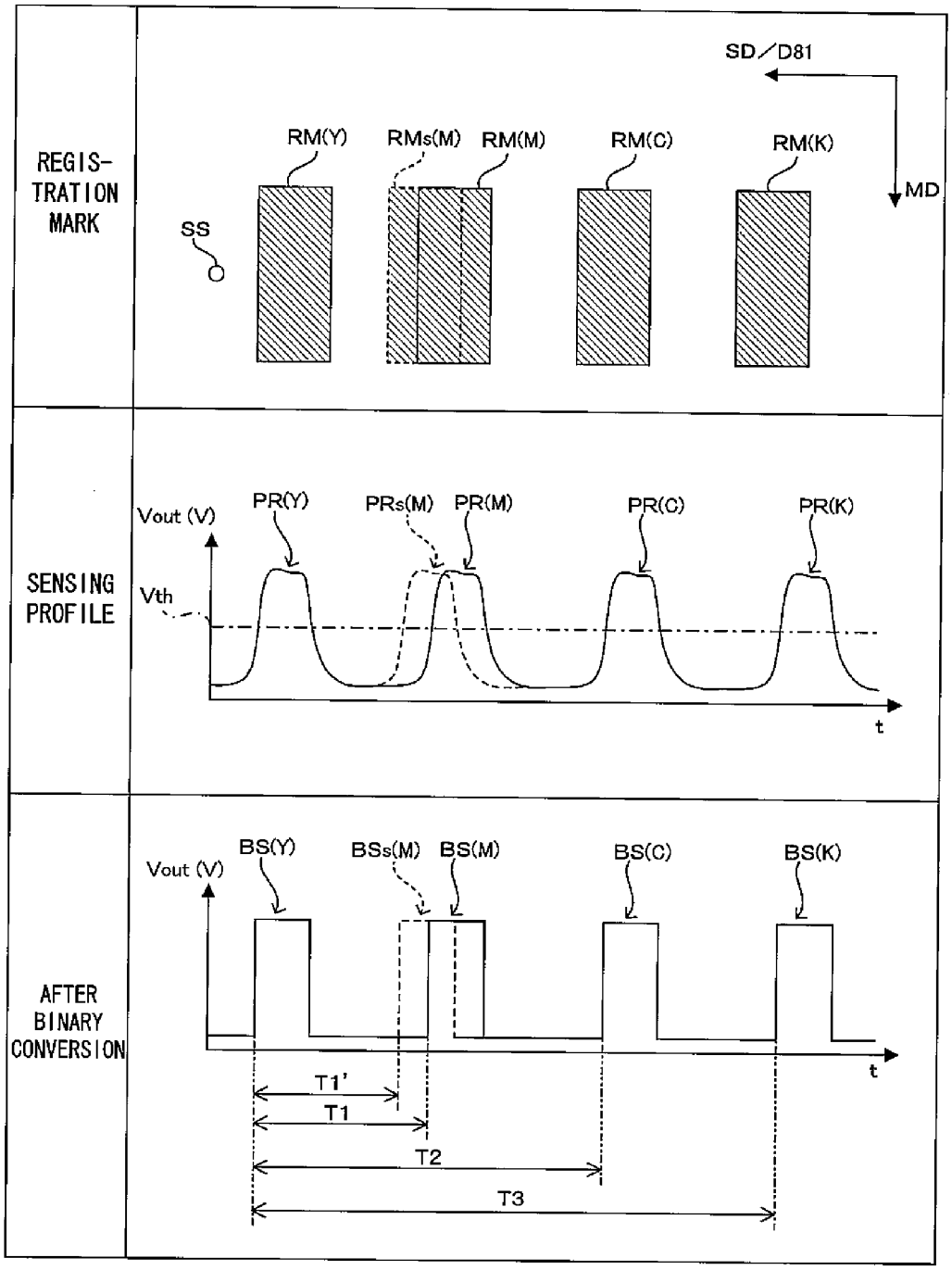
FIG. 19 is a diagram showing a process performed based on the detection result of the optical sensor.
Figure 20:
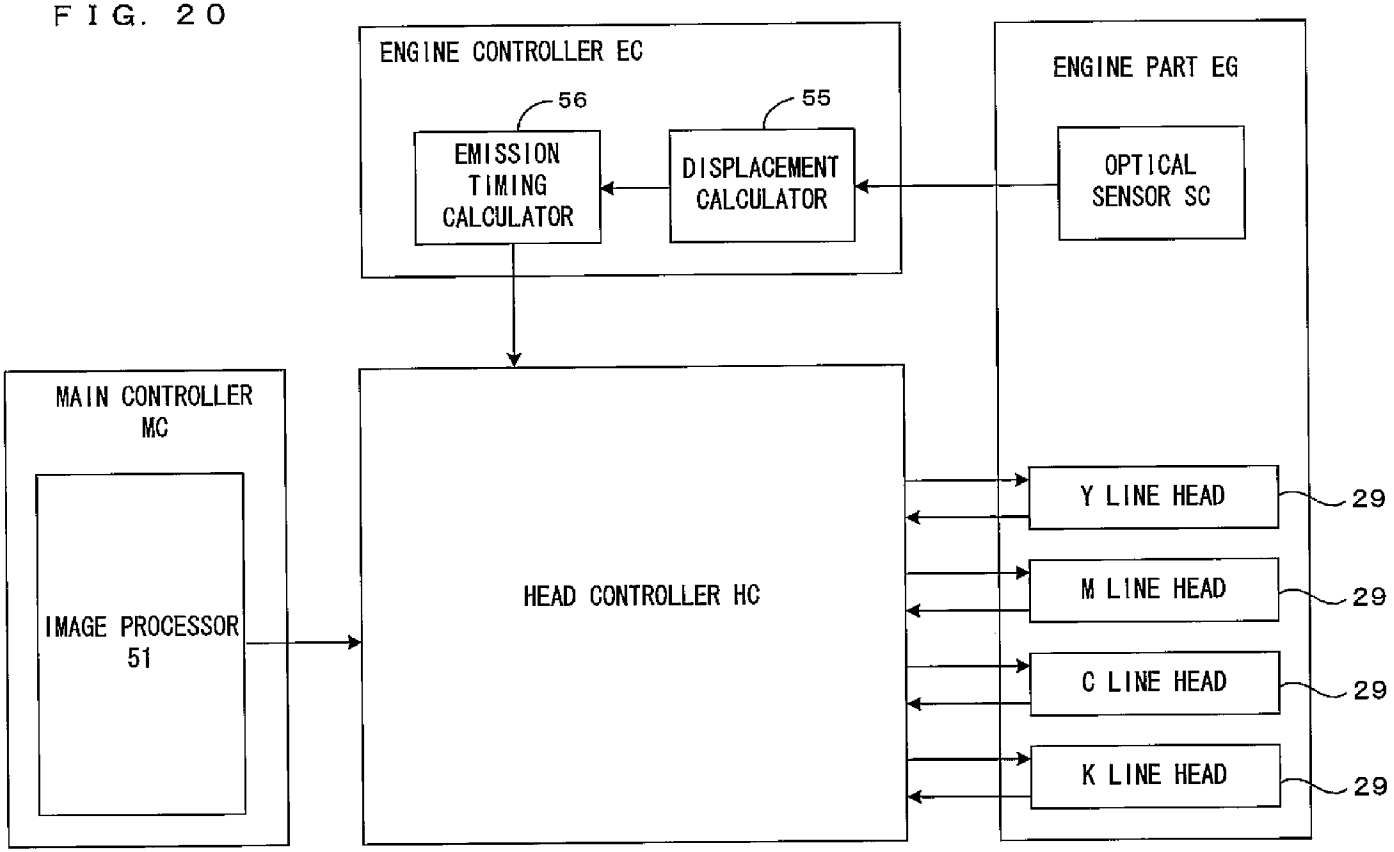
FIG. 20 is a diagram showing an electrical construction for performing the process based on the detection result of the optical sensor.

FIG. 19 is a diagram showing a process performed based on the detection result of the optical sensor, and FIG. 20 is a diagram showing an electrical construction for performing the process based on the detection result of the optical sensor. In order to facilitate the understanding of the process in the color misregistration correction operation, it is assumed here that the formation positions of only the registration marks RM of magenta (M) are displaced and the registration marks RM of the other colors are formed at ideal positions. In the row "REGISTRATION MARK" of FIG. 19, the registration marks RM(Y), RM(M), RM(C) and RM(K) shown by solid line are the registration marks of the respective colors in an ideal case free from color misregistration, and registration marks RMs(M) shown by broken line is the registration mark of magenta (M) actually displaced. As described above, the registration marks RM of the respective colors are formed side by side in the conveying direction D81 and pass the sensor spot SS by being conveyed in the conveying direction D81. In this way, the registration marks RM of the respective colors are detected by the optical sensor.

In the row "SENSING PROFILE" of FIG. 19 is shown a detection result of the optical sensor SC. When the registration marks RM(Y), RM(M), RM(C) and RM(K) pass the sensor spot SS, the optical sensor SC outputs detected waveforms PR(Y), PR(M), PR(C) and PR(K) corresponding to the respective registration marks to a displacement calculator 55. These detected waveforms are outputted as voltage signals. In an example shown in FIG. 19, the registration mark of magenta (M) is displaced. Accordingly, the optical sensor SC actually detects the registration mark RMs(M) shown by broken line and outputs a detected waveform PRs(M). This displacement calculator 55 and an emission timing calculator 56 to be described later are both provided in the engine controller EC.

In the displacement calculator 55, the detected waveforms PR(Y), PR(M), PR(C) and PR(K) outputted from the optical sensor SC are converted into binary values using a threshold voltage Vth to obtain binary signals BS(Y), BS(M), BS(C) and BS(K) as shown in the row "AFTER BINARY CONVERSION" of FIG. 19. In the example shown in FIG. 19, the registration mark of magenta (M) is displaced. Accordingly, the displacement calculator 55 generates a binary signal BSs (M) shown by broken line by converting the detected waveform PRs(M) into a binary value. The displacement of the formation position of the registration mark RMs(M) of magenta (M) is calculated from a time interval (time interval Tym) between a rising edge of the binary signal BS(Y) of yellow (Y) as a reference and a rising edge of the binary signal BS of magenta (M). In other words, if Dm: displacement of the registration mark RMs(M) relative to the registration mark RM(Y), S81: conveying velocity of the surface of the transfer belt, T1: time interval Tym in the absence of displacement T1': time interval Tym in the presence of displacement, the displacement Dm of magenta (M) is calculated by the following equation.

$$Dm=S81\times(T1-T1')$$

The displacement Dm thus calculated is outputted to the emission timing calculator 56, which then calculates an optimal emission timing based on the displacement Dm. The light emission of the line head 29 is controlled based on the thus calculated emission timing to control the transferred position of the toner image to correct the color misregistration.

As described above, in the color misregistration correction operation, the test latent images are formed on the photosensitive member surface and are developed to form the registration marks RM (detection image) on the surface of the transfer belt. Then, the registration marks RM are detected by the optical sensor SC and the color misregistration is corrected based on the detection values. As described above with reference to FIG. 15, etc., there are cases where the positions of the latent images vary for the respective light emitting element groups due to a variation of the moving speed of the photosensitive member surface. Accordingly, such a positional variation may occur also in the test latent images formed in the color misregistration correction. A similar variation may occur also in the registration marks RM (detection images) obtained by developing the test latent images with such a positional variation. In other words, as shown in FIG. 21 to be described later, there have been cases where the positions of the toner images corresponding to the respective light emitting element groups vary and the detection results on the registration marks RM by the optical sensor SC are unstable.

Figure 21:
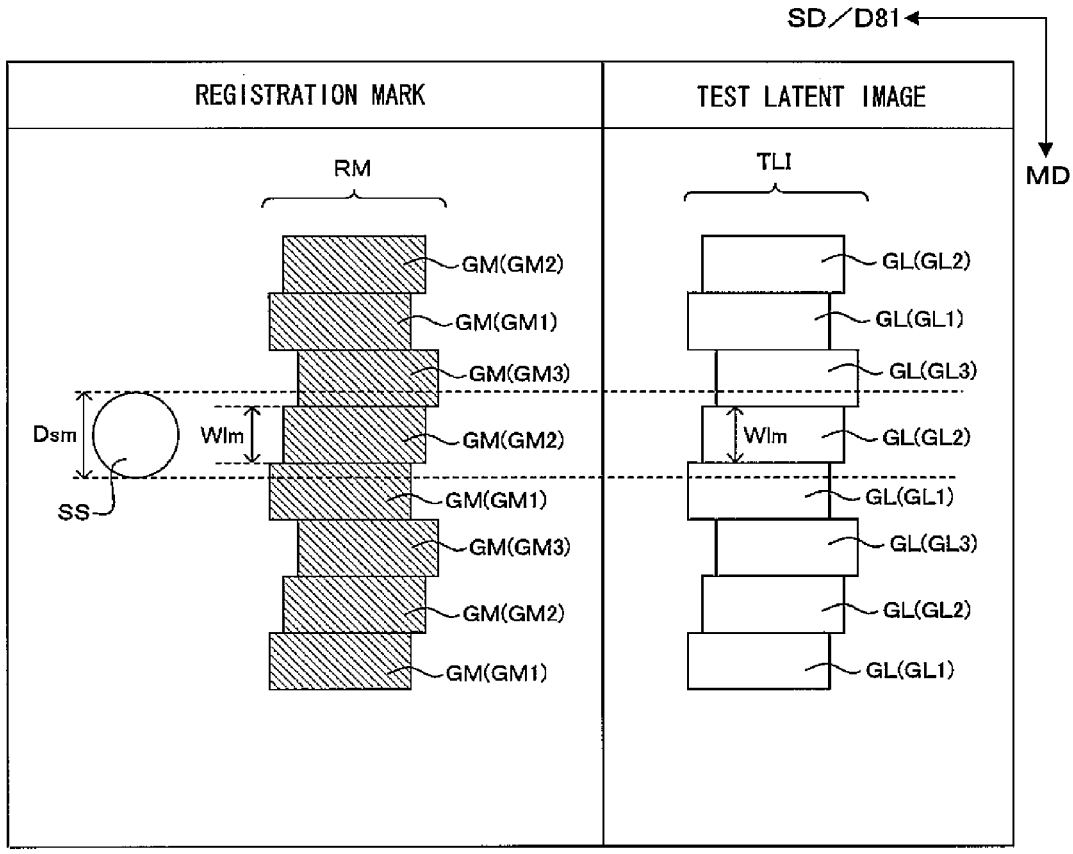
FIG. 21 is a diagram showing an example of the detection result by the optical sensor for the registration marks whose positions vary for the respective light emitting element groups.

FIG. 21 is a diagram showing an example of the detection result by the optical sensor for the registration marks whose positions vary for the respective light emitting element groups. As shown in the column "TEST LATENT IMAGE" of FIG. 21, a test latent image TLI is made up of a plurality of (eight) group latent images GL consecutive and adjacent in the main scanning direction MD and has a width larger than the sensor spot SS in the main scanning direction MD. Each group latent image GL constituting the test latent image TLI is formed by all the light emitting elements 2951 belonging to the light emitting element group 295 and has a unit width Wlm in the main scanning direction MD. Here, the unit width Wlm is the width of a group latent image GL in the main scanning direction MD in the case of forming the group latent image GL by all the light emitting elements 2951 belonging to one light emitting element group 295. As shown in FIG. 21, the positions of the group latent images GL constituting the test latent image TLI vary in the sub scanning direction SD due to a variation of the surface speed of the photosensitive drum 21.

As shown in the column "REGISTRATION MARK" of FIG. 21, this test latent image TLI is developed with toner to form a registration mark RM, which has a configuration similar to that of the test latent image TLI. In other words, the registration mark RM is made up of a plurality of (eight) group toner images GM consecutive and adjacent in the main scanning direction MD and has a width larger than the sensor spot SS in the main scanning direction MD. Here, the group toner image GM is an image obtained by developing the group latent image GL with toner and corresponds to a "group image" of the invention. In an example shown in FIG. 21, each group toner image GM has the unit width Wlm in the main scanning direction MD. The registration mark RM is conveyed in the conveying direction D81 of the transfer belt 81 as the transfer belt 81 moves, and passes the sensor spot SS of the optical sensor SC. This sensor spot SS has a main-scanning spot diameter Dsm larger than the unit width Wlm in the main scanning direction MD, and the registration mark RM located between two broken lines sandwiching the sensor spot SS passes the sensor spot SS. Here, the main-scanning spot diameter Dsm is the width of the sensor spot SS in the main scanning direction MD.

As described above, in the example shown in FIG. 21, the registration mark RM is made up of the group toner images consecutive and adjacent in the main scanning direction MD, and the sensor spot SS has the main-scanning spot diameter Dsm larger than the unit width Wlm. Accordingly, the plurality of group toner images GM whose positions vary from each other in the sub scanning direction SD pass the sensor spot SS to be detected by the optical sensor SC. As a result, there have been cases where the detection result on the registration mark RM (detection image) is not stable and the position of the registration mark RM cannot be properly obtained. Thus, in embodiments of the invention, the occurrence of the problem shown in FIG. 21 is suppressed by performing the operation of detecting the registration mark RM as follows.

VI-1. First Embodiment

Figure 22:
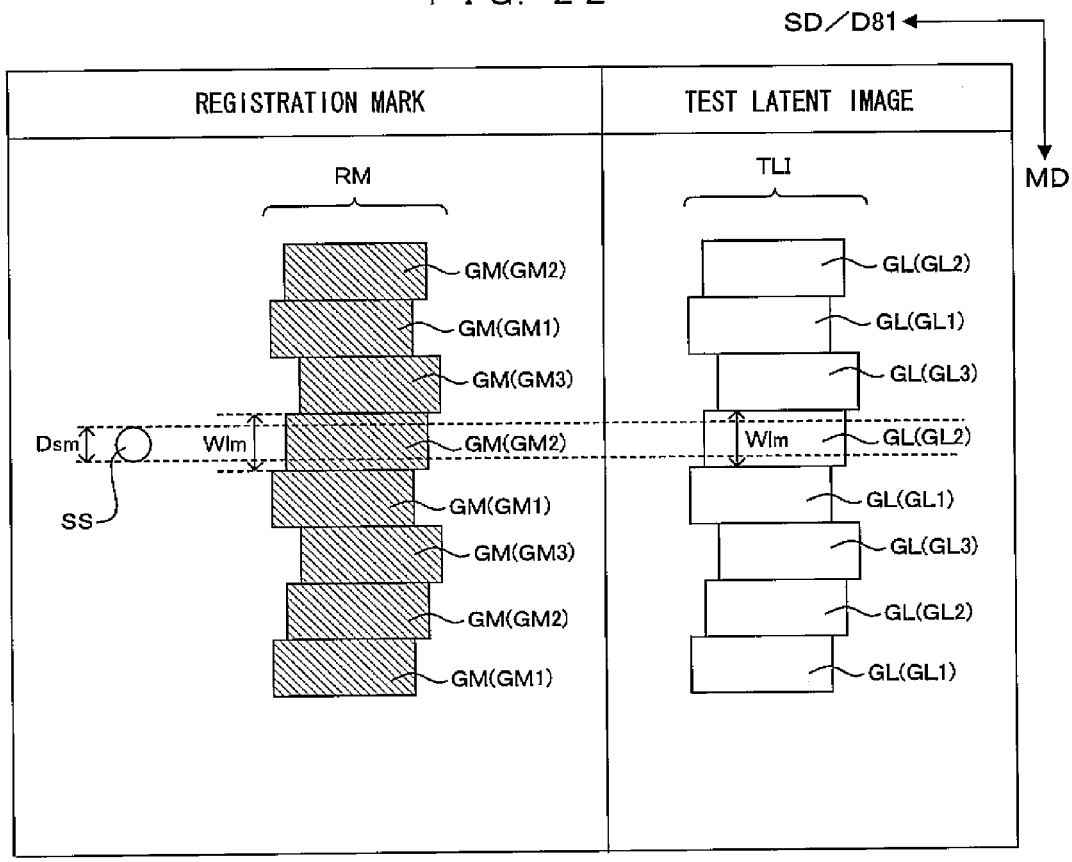
FIG. 22 is a diagram showing a registration mark detecting operation in a first embodiment.

FIG. 22 is a diagram showing a registration mark detecting operation in a first embodiment. In the registration mark detecting operation of the first embodiment, a registration mark RM has a configuration similar to that of the registration mark RM shown in FIG. 21. In other words, the registration mark RM is made up of a plurality of (eight) group toner images GM consecutive and adjacent in the main scanning direction MD and has a width larger than a sensor spot SS in the main scanning direction MD.

On the other hand, in the registration mark detecting operation of the first embodiment, the configuration of the sensor spot SS of an optical sensor SC for detecting the registration mark RM is different from the one shown in FIG. 21. In the first embodiment, a main-scanning spot diameter Dsm of the sensor spot SS is smaller than the unit width Wlm. The registration mark RM located between two broken lines sandwiching the sensor spot SS in the main scanning direction MD passes the sensor spot SS. In other words, only one (group toner image GM2 in an example shown in FIG. 22) of the group toner images GM constituting the registration mark RM passes the sensor spot SS. As a result, the operation of detecting the registration mark RM is performed through the detection of one group toner image GM by the optical sensor SC.

As described above, in the first embodiment, the registration mark RM is detected by detecting only one group toner image GM. This accordingly suppresses the occurrence of a situation where a plurality of group toner images GM whose positions vary from each other in the sub scanning direction SD pass the sensor spot SS to be detected by the optical sensor SC. Therefore, the position of the registration mark RM can be properly obtained by making the detection result on the registration mark RM stable.

VI-2. Second Embodiment

Figure 23:
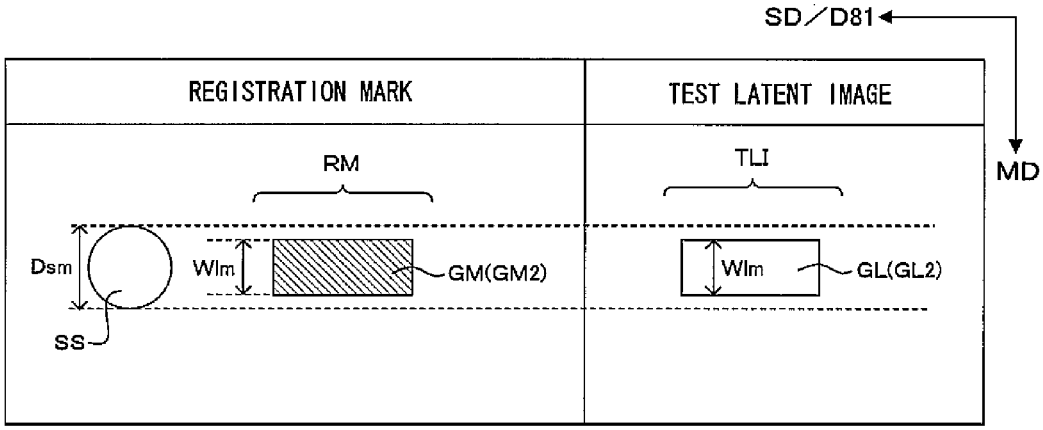
FIG. 23 is a diagram showing a registration mark detecting operation in a second embodiment.

FIG. 23 is a diagram showing a registration mark detecting operation in a second embodiment. As shown in FIG. 23, in the second embodiment, a test latent image TLI is made up of only one group latent image GL (GL2), with the result that a registration mark RM is made up of only one group toner image GM (GM2). This group toner image GM (and the group latent image GL) is formed by all the light emitting elements 2951 belonging to the light emitting element group 295 and has the unit width Wlm in the main scanning direction MD. This registration mark RM is conveyed in the conveying direction D81 to pass a sensor spot SS of an optical sensor SC. This sensor spot SS has a main-scanning spot diameter Dsm larger than the unit width Wlm, and the registration mark RM located between two broken lines sandwiching this sensor spot SS in the main scanning direction MD passes the sensor spot SS. In other words, only one group toner image GM (group toner image GM2 in an example shown in FIG. 23) passes the sensor spot SS. As a result, in the second embodiment as well, the registration mark RM is detected through the detection of only one group toner image GM by the optical sensor SC.

As described above, in the second embodiment as well, the registration mark RM is detected by detecting only one group toner image GM. This accordingly suppresses the occurrence of a situation where a plurality of group toner images GM whose positions vary from each other in the sub scanning direction SD pass the sensor spot SS to be detected by the optical sensor SC. Therefore, the position of the registration mark RM can be properly obtained by making the detection result on the registration mark RM stable.

In the second embodiment, the group toner image GM is formed by all the light emitting elements 2951 belonging to the light emitting element group 295. Accordingly, the group toner image GM has a maximum possible width (unit width Wlm) in the main scanning direction MD. Therefore, the detection result on the registration mark RM can be made more stable.

VI-3. Third Embodiment

In the tandem image forming apparatus as described above, the image forming stations Y, M, C and K form registration marks RM(Y), RM(M), RM(C) and RM(K) of the corresponding colors. Accordingly, if the mount positions of the line heads 29 in the respective image forming stations are displaced from each other in the main scanning direction MD, there have been cases where even if the occurrence of the above problem can be suppressed for a certain color to satisfactorily detect the registration mark RM, the above problem occurs for other colors and the registration marks RM cannot be satisfactorily detected.

Figure 24:
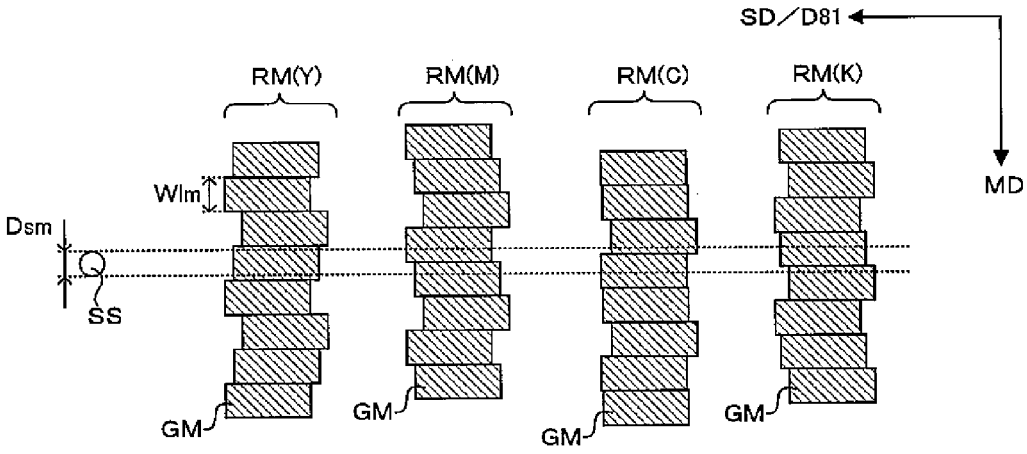
FIG. 24 is a diagram showing a problem which could occur in a tandem image forming apparatus.

FIG. 24 is a diagram showing a problem which could occur in a tandem image forming apparatus. As shown in FIG. 24, any of registration marks RM(Y), RM(M), RM(C) and RM(K) is made up of a plurality of (eight) group toner images GM consecutive and adjacent in the main scanning direction MD. Each group toner image GM is formed by all the light emitting elements 2951 belonging to the light emitting element group 295 and has the unit width Wlm in the main scanning direction MD.

In FIG. 24, the formation positions of the registration marks RM(Y), RM(M), RM(C) and RM(K) are displaced from each other in the main scanning direction MD due to relative displacements of the mount positions of the line heads 29 in the main scanning direction MD in the respective image forming stations. As a result, the registration mark RM(Y) of yellow (Y) is detected when only one group toner image GM passes a sensor spot SS, but each of the registration marks RM(M), RM(C) and RM(K) of the other colors is detected when two group toner images relatively displaced in the sub scanning direction SD pass the sensor spot SS. In an example shown in FIG. 24, a main-scanning spot diameter Dsm of the sensor spot SS is smaller than the unit width Wlm, and the registration mark RM between two broken lines sandwiching this sensor spot SS in the main scanning direction MD passes the sensor spot SS. It may be thought to provide an optical sensor SC for each color in order to cope with such a problem. However, such a construction cannot be necessarily said to be proper since it leads to a cost increase and a complicated construction. Therefore, in a third embodiment, the line heads 29 of the respective image forming stations are positioned as follows.

Figure 25:
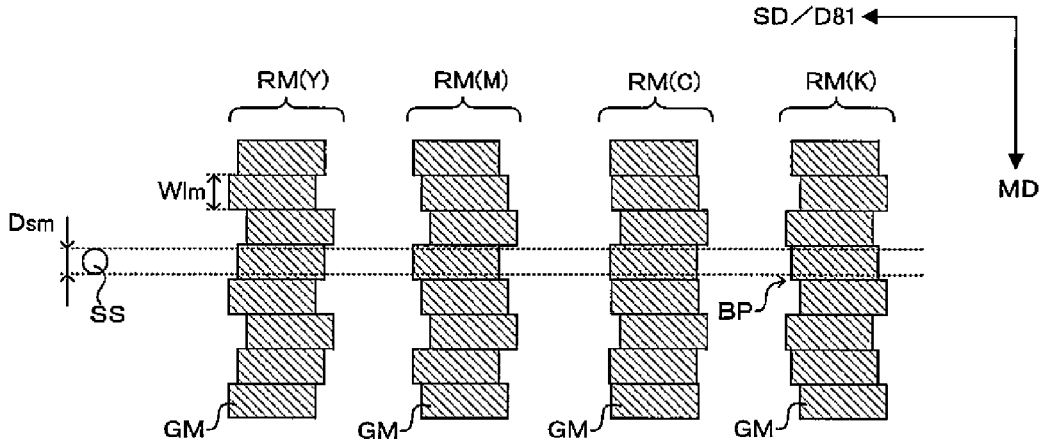
FIG. 25 is a diagram showing registration marks formed by line heads according to the third embodiment.

FIG. 25 is a diagram showing registration marks formed by line heads according to the third embodiment. In the third embodiment, the positions of the line heads 29 in the main scanning direction MD are adjusted among the respective image forming stations to solve displacements of the mounted positions of the line heads 29 in the main scanning direction MD. Such positional adjustments of the line heads 29 may be performed at the time of shipment of the image forming apparatus or may be performed by a service person after shipment. By such positional adjustments, the formation positions of the respective registration marks RM(Y), RM(M), RM(C) and RM(K) substantially coincide in the main scanning direction MD. Thus, the registration marks RM(Y), RM(M), RM(C) and RM(K) of all the colors are detected when only one group toner image GM passes the sensor spot SS.

As described above, in the third embodiment, the line head 29 of each color is positioned such that only one of the group toner images GM constituting the registration mark RM formed by this line head 29 passes the sensor spot SS. Therefore, the registration mark RM of each color can be detected by one optical sensor SC, and the cost reduction and simplification of the apparatus construction are realized.

VI-4. Color Misregistration Correction Operation in the Main Scanning Direction

In the above embodiment, the invention is applied to the color misregistration correction operation for suppressing the color misregistration in the sub scanning direction SD. However, the application of the invention is not limited to this and the invention may also be applied to a color misregistration correction operation for suppressing the color misregistration in the main scanning direction MD. This will be described below.

Figure 26:
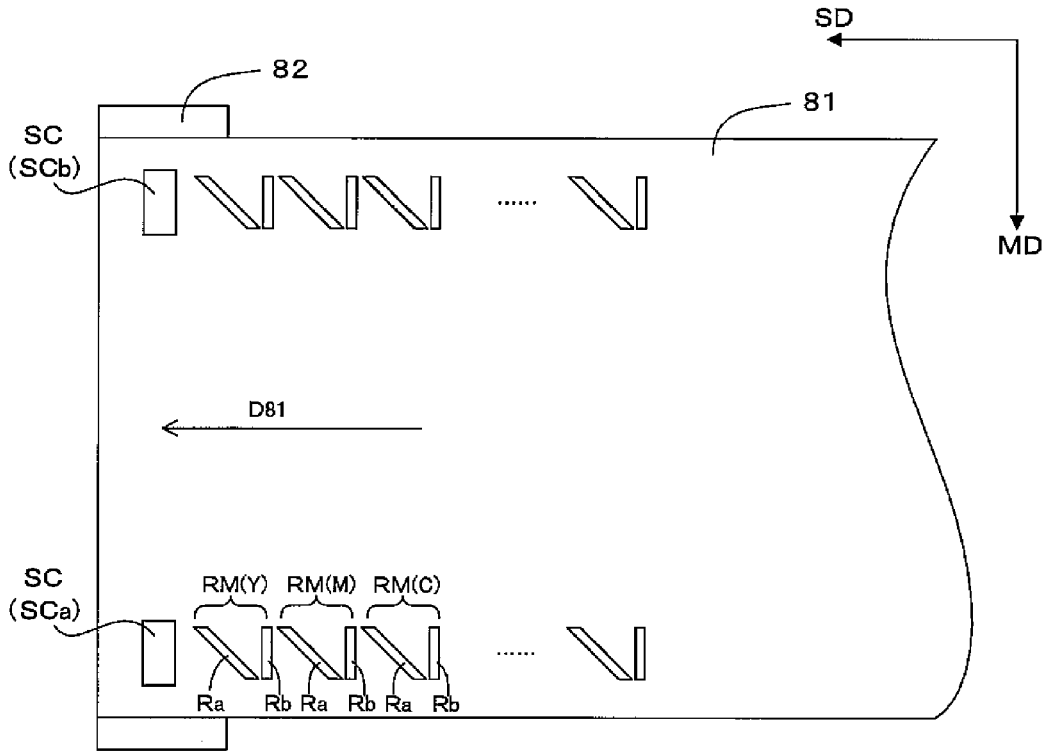
FIG. 26 is a diagram showing registration marks formed in a color misregistration correction operation in the main scanning direction.

FIG. 26 is a diagram showing registration marks formed in a color misregistration correction operation in the main scanning direction. The color misregistration correction operation in the main scanning direction is similar to the above color misregistration correction operation in that registration marks RM(Y), RM(M), RM(C) and RM(K) of the respective colors Y, M, C and K are formed side by side in the sub scanning direction SD. However, the configurations of the respective registration marks RM(Y), RM(M), RM(C) and RM(K) differ between the color misregistration correction operation in the main scanning direction and the above color misregistration correction operation. In other words, in the color misregistration correction operation in the main scanning direction, each of the registration mark RM(Y), etc. is made up of an oblique part Ra oblique to the main scanning direction MD and a horizontal part Rb substantially parallel to the main scanning direction MD. By detecting the registration marks RM(Y), etc. made up of the oblique parts Ra and the horizontal parts Rb by optical sensors SC, displacements of the registration marks RM(Y), etc. in the main scanning direction MD can be detected.

Figure 27:
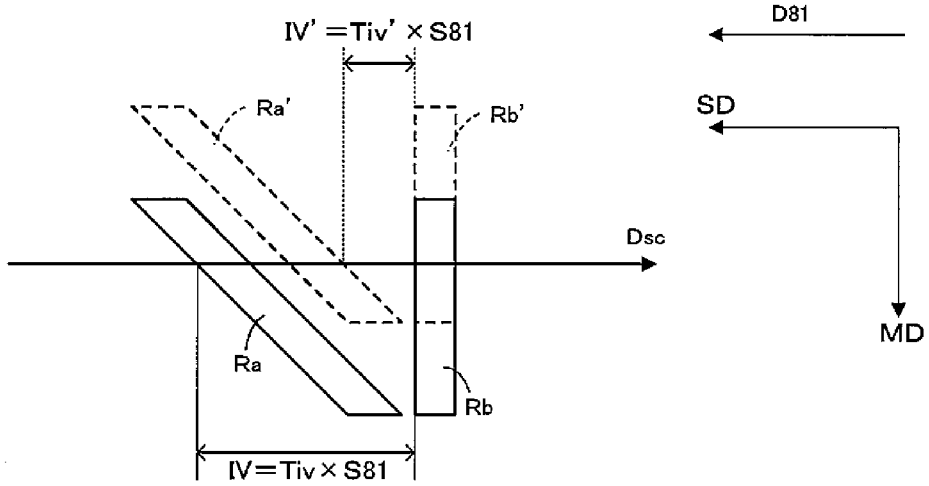
FIG. 27 is a diagram showing the principle of the color misregistration correction operation in the main scanning direction.

FIG. 27 is a diagram showing the principle of the color misregistration correction operation in the main scanning direction. The registration mark Ra, Rb shown by solid line in FIG. 27 corresponds the registration mark free from displacement, and the registration mark Ra', Rb' shown by broken line in FIG. 27 corresponds to the registration mark having being displaced.

First of all, a detection operation of the registration mark Ra, Rb free from displacement will be described. Since the transfer belt 81 moves in the moving direction D81 as described above, the registration marks Ra, Rb also moves in the moving direction D81 as this transfer belt 81 moves. Then, the registration mark Ra, Rb passes a sensor spot (not shown in FIG. 27 of the optical sensor SC to be detected by the optical sensor SC. In other words, the sensor spot passes above the registration mark Ra, Rb in a direction of arrow Dsc shown in FIG. 27 to detect the registration mark Ra, Rb. Accordingly, the optical sensor SC detects a downstream edge of the horizontal part Rb in the moving direction D81 after first detecting a downstream edge of the oblique part Ra in the moving direction D81. At this time, an interval between the downstream edge of the oblique part Ra and the downstream edge of the horizontal part Rb on the arrow Dsc is an interval IV. Accordingly, an edge detection time Tiv from the edge detection of the oblique part Ra to that of the horizontal part Rb is obtained from an equation (IV/S81), where S81 is a conveying speed of the transfer belt 81.

On the other hand, in an example shown in FIG. 27, the registration mark Ra', Rb' is displaced upward relative to the registration mark Ra, Rb. As a result, an interval IV' between the downstream edge of the oblique part Ra' and the downstream edge of the horizontal part Rb' on the arrow Dsc in the registration mark Ra', Rb' thus displaced is shorter as compared with the case free from displacement (i.e. IV'<IV). Accordingly, an edge detection time Tiv' (=IV'/S81) from the edge detection of the oblique part Ra' to that of the horizontal part Rb' is also shorter than the edge detection time Tiv in the case free from displacement (i.e. Tiv'<Tiv). If the registration mark Ra', Rb' is displaced downward contrary to the example shown in FIG. 27, the edge detection time Tiv' becomes longer than the edge detection time Tiv (i.e. Tiv'>Tiv). As described above, if the registration marks RM(Y), etc. are displaced, the edge detection times Tiv from the downstream edge detections of the oblique parts Ra to those of the horizontal parts Rb vary. Therefore, in this color misregistration correction operation, displacements in the main scanning direction MD among the respective colors are calculated from the edge detection times Tiv.

Figure 28:
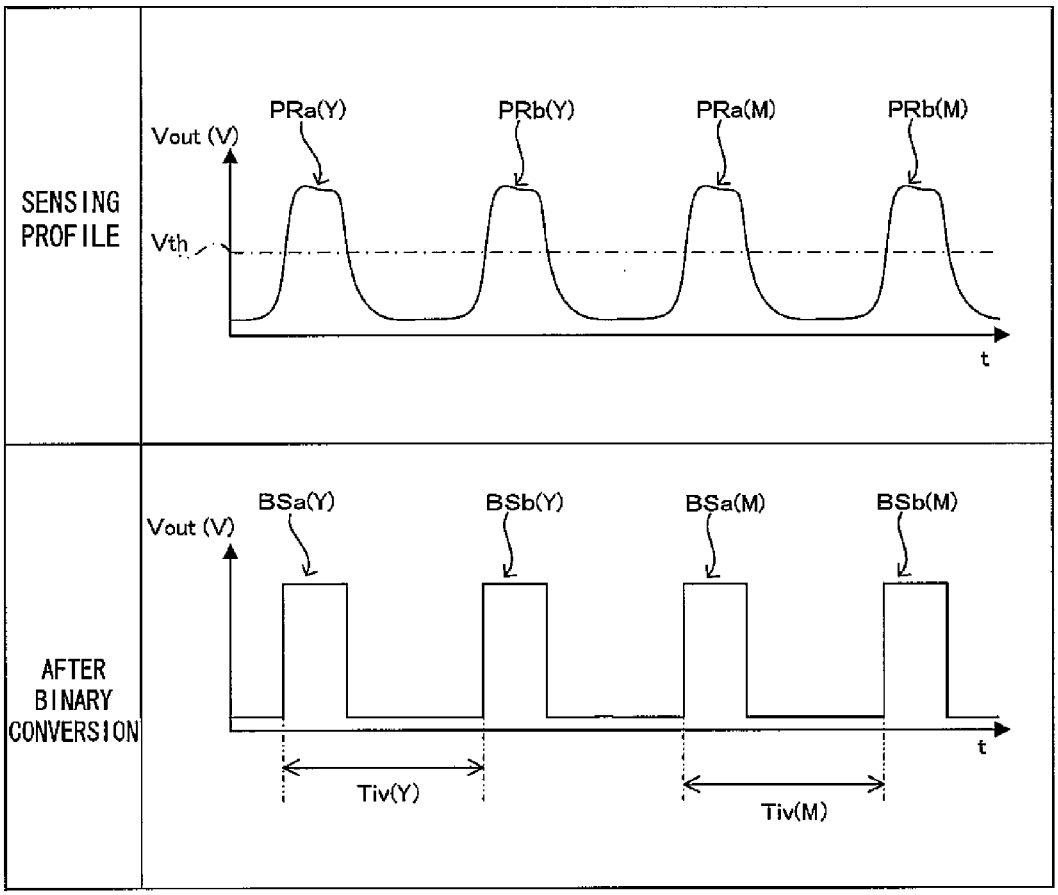
FIG. 28 is a group of graphs showing the color misregistration correction operation in the main scanning direction.

FIG. 28 is a group of graphs showing the color misregistration correction operation in the main scanning direction. FIG. 28 shows a case where a displacement in the main scanning direction MD between yellow (Y) and magenta (M) is calculated. In the row "SENSING PROFILE" of FIG. 28 are shown signals outputted from the optical sensor SC upon detecting the registration marks RM(Y), etc. In the row "AFTER BINARY CONVERSION" of FIG. 28 are shown signals obtained by converting the signals shown in the sensing profile into binary values using a threshold voltage Vth. As shown in the sensing profile, the oblique part Ra of the registration mark RM(Y) of yellow (Y) is first detected to obtain a profile signal PRa(Y) and then the horizontal part Rb of the registration mark RM(Y) of yellow (Y) is detected to obtain a profile signal PRb(Y). Subsequently, the oblique part Ra of the registration mark RM(M) of magenta (M) is detected to obtain a profile signal PRa(M) and then the horizontal part Rb of the registration mark RM(M) of magenta (M) is detected to obtain a profile signal PRb(M).

The respective profile signals PRa(Y), PRb(Y), PRa(M) and PRb(M) thus obtained are converted into binary values to obtain binary signals BSa(Y), BSb(Y), BSa(M) and BSb(M). The edge detection times Tiv for the respective colors are calculated from rising edge intervals of the binary signals BSa(Y), BSb(Y), BSa(M) and BSb(M). Specifically, the edge detection time Tiv(Y) of yellow (Y) is calculated from the rising edges of the binary signals BSa(Y), BSb(Y), and the edge detection time Tiv(M) of magenta (M) is calculated from the rising edges of the binary signals BSa(M), BSb(M). By multiplying a difference between the edge detection times Tiv of the respective colors (=Tiv(Y)−Tiv(M)) by the moving speed S81 of the transfer belt 81, a displacement in the main scanning direction MD between the registration marks RM(Y) and RM(M) can be calculated.

Figure 29:
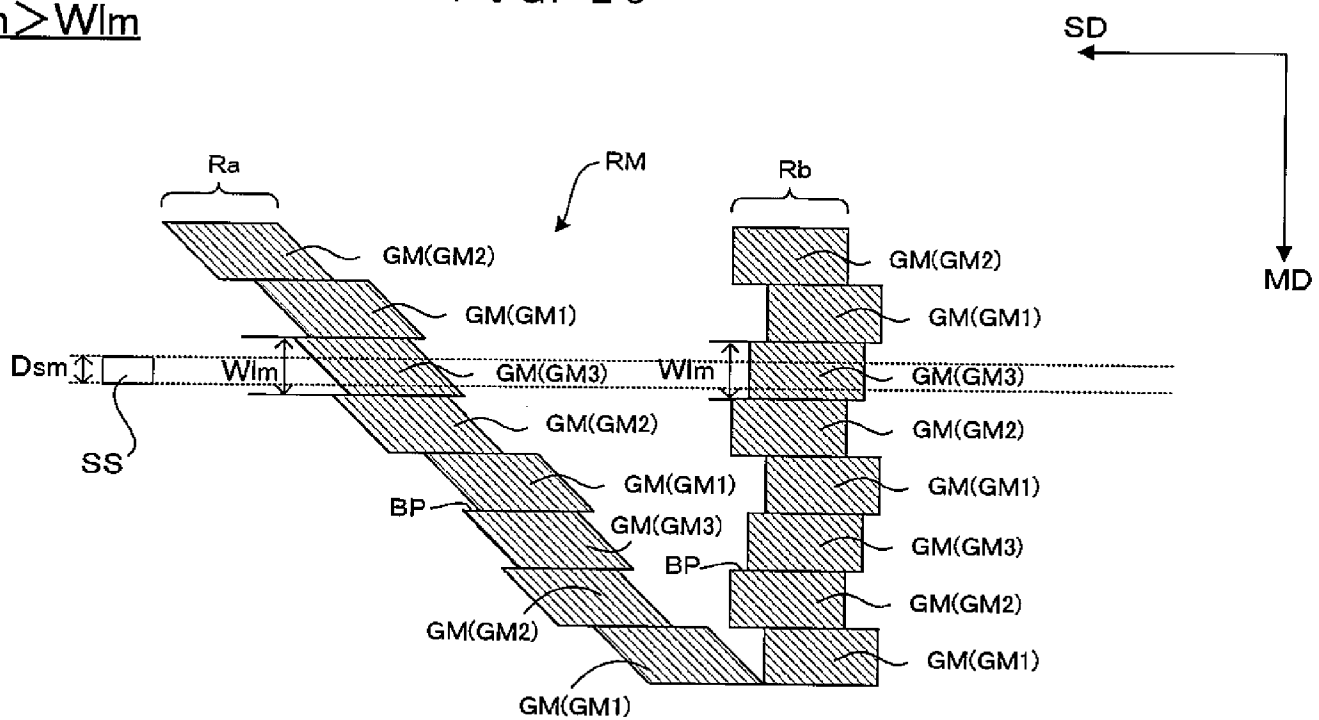
FIG. 29 is a diagram showing the configuration of the registration mark formed in the color misregistration correction shown in FIG. 26.

FIG. 29 is a diagram showing the configuration of the registration mark formed in the color misregistration correction shown in FIG. 26. As shown in FIG. 29, group toner images GM vary to form steps BP at boundary parts between the respective group toner images GM in each of the oblique part Ra and the horizontal part Rb of the registration mark RM. On the contrary, a spot of an optical sensor SC has the following configuration. In other words, a main-scanning spot diameter Dsm of the optical sensor SC is set smaller than the width of one group toner image GM in the main scanning direction MD and, according to an example of FIG. 29, the line head 29 is positioned such that only one group toner image GM (group toner image GM3) passes the sensor spot SS. This accordingly suppresses the occurrence of a situation where a plurality of group toner images GM whose positions vary from each other in the sub scanning direction SD pass the sensor spot SS to be detected by the optical sensor SC. Therefore, the position of the registration mark RM can be properly obtained by making the detection result on the registration mark RM stable.

VI-5. Color Misregistration Correction Operation Due to Sub Scanning Magnification In the above color misregistration correction operation, displacements among mutually different colors are calculated by detecting the registration marks RM. However, besides displacements among mutually different colors, there are cases where a displacement called "sub scanning magnification displacement" occurs for one color. Specifically, there are cases where the speed of the photosensitive drum 21 is faster or slower than a desired speed, for example, for a certain color to contract or extend an image transferred to the transfer belt 81, with the result that the image transferred to the transfer belt 81 looks as if the magnification thereof would have been deviated in the sub scanning direction SD (as if a sub scanning magnification displacement would have occurred). Such a sub scanning magnification displacement can also be calculated by detecting the registration mark RM as described next.

Figure 30:
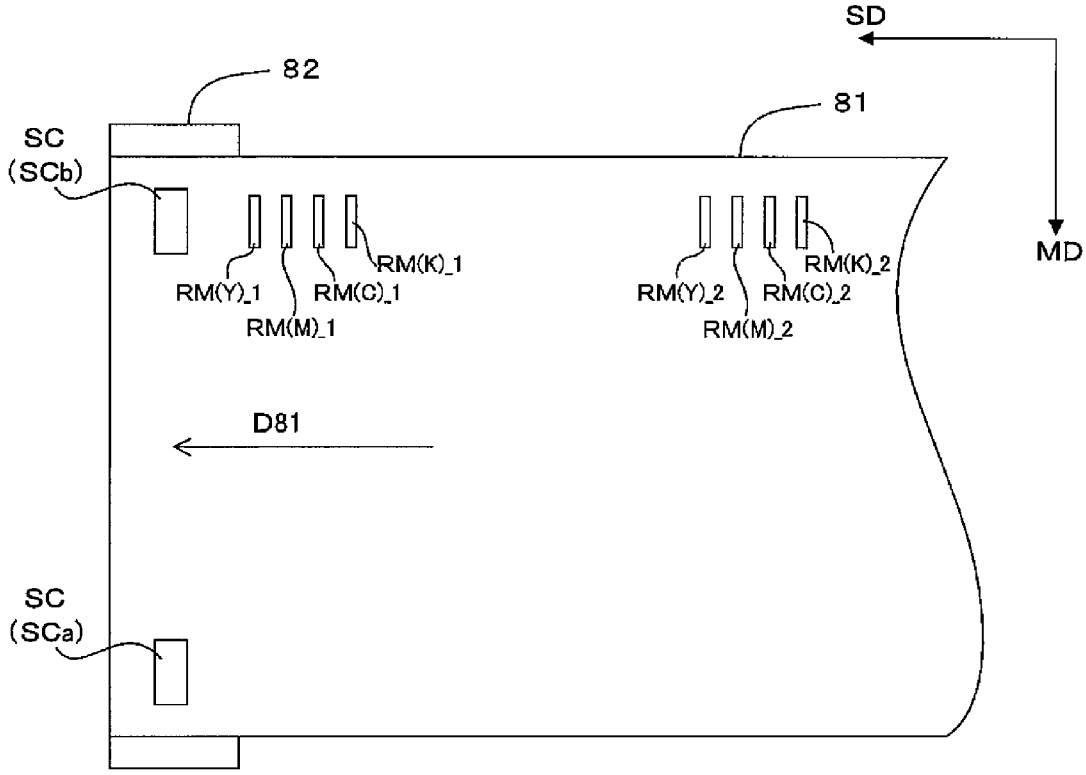
FIG. 30 is a diagram showing registration marks formed in a sub scanning magnification displacement correction operation.

FIG. 30 is a diagram showing registration marks formed in a sub scanning magnification displacement correction operation. As shown in FIG. 30, two registration marks RM are formed for each of the colors Y, M, C and K while being spaced apart in the sub scanning direction SD. For example, for yellow (Y), the registration marks RM(Y)_1, RM(Y)_2 are formed while being spaced apart in the sub scanning direction SD. These two registration marks RM(Y)_1, RM(Y)_2 are detected by an optical sensor SC to calculate a sub scanning magnification displacement for yellow (Y).

Figure 31:
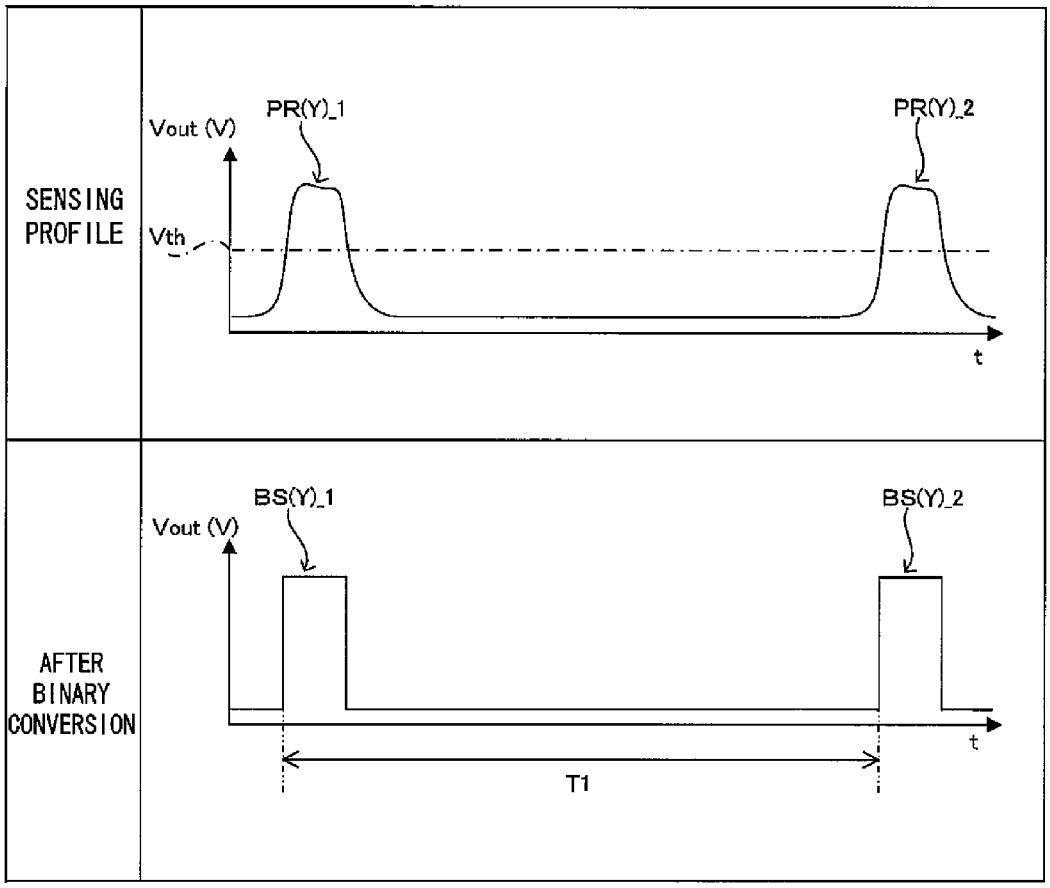
FIG. 31 is a group of graphs showing the sub scanning magnification displacement correction operation.

FIG. 31 is a group of graphs showing the sub scanning magnification displacement correction operation and corresponds to a case of calculating the sub scanning magnification displacement for yellow (Y). In the row "SENSING PROFILE" of FIG. 31 are shown signals outputted by the optical sensor SC upon detecting the registration marks RM(Y)_1, RM(Y)_2. In the row "AFTER BINARY CONVERSION" of FIG. 31 are shown signals obtained by converting the signals shown in the sensing profile into binary values using a threshold voltage Vth. As shown in the sensing profile, the downstream registration mark RM(Y)_1 in the moving direction D81 of the transfer belt 81 is first detected to obtain a profile signal PR(Y)_1 and, then, the upstream registration mark RM(Y)_2 in the moving direction D81 is detected to obtain a profile signal PR(Y)_2.

The respective profile signals PR(Y)_1, PR(Y)_2 thus obtained are converted into binary values to obtain binary signals BSa(Y), BSb(Y). An edge detection time T1 is calculated from a rising edge interval of the binary signals BSa(Y), BSb(Y), and an interval between the registration marks PR(Y)_1, PR(Y)_2 in the sub scanning direction SD is calculated by multiplying this edge detection time T1 by the conveying speed S81 of the transfer belt 81. Then, by calculating how far the thus calculated interval between the registration marks PR(Y)_1, PR(Y)_2 is deviated from a desired value, the sub scanning magnification displacement can be calculated for yellow (Y). Sub scanning magnification displacements can be similarly calculated for the colors other than yellow (Y). By controlling, for example, the emission timings of the light emitting elements 2951 based on the thus calculated sub scanning magnification displacements, the length of the image to be transferred to the transfer belt 81 in the sub scanning direction SD can be set to a suitable length.

The invention is also applicable to a color misregistration correction operation resulting from a sub scanning magnification. In other words, by configuring the sensor spot SS and the registration mark as in the first to third embodiments described above and detecting only one group toner image GM by means of the optical sensor SC, the occurrence of a situation where a plurality of group toner images GM whose positions vary from each other in the sub scanning direction SD pass the sensor spot SS to be detected by the optical sensor SC is suppressed. Therefore, the position of the registration mark RM can be properly obtained by making the detection result on the registration mark RM stable.

VI-6. Modified Embodiment of the Optical Sensor

Figure 32:
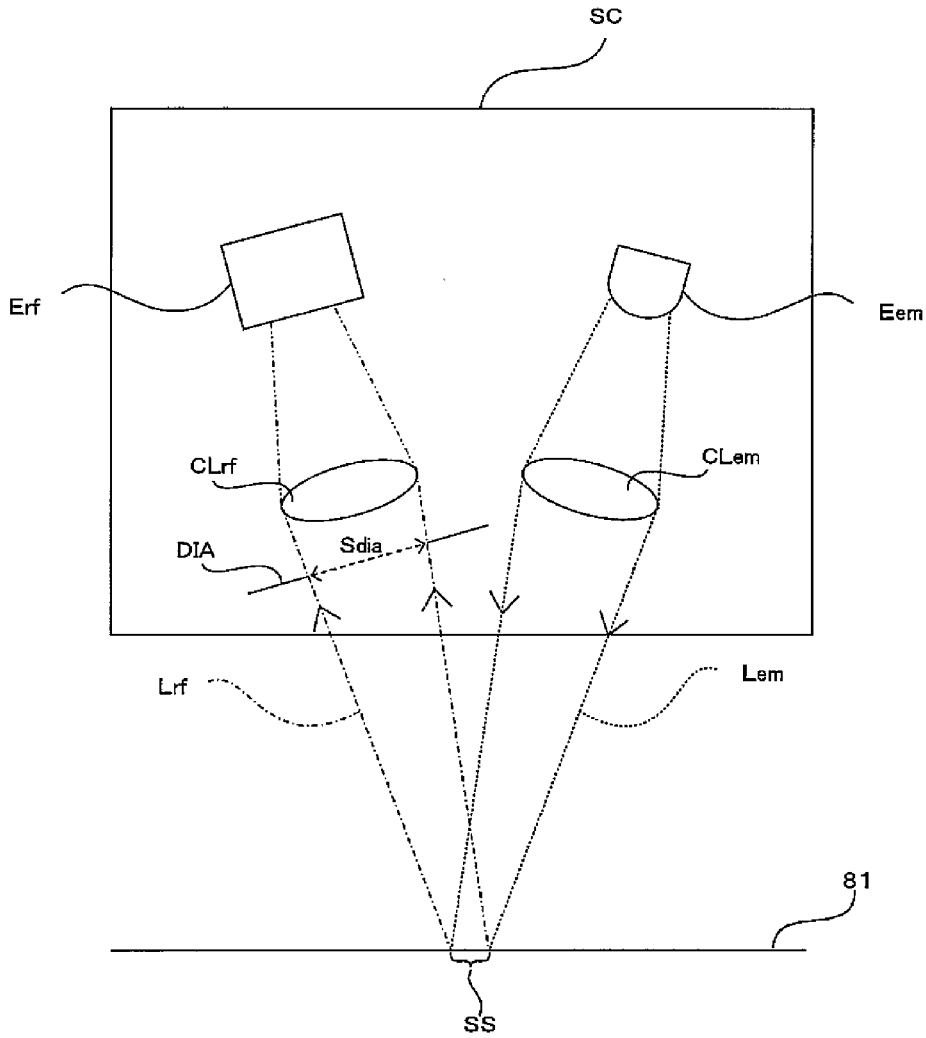
FIG. 32 is a view diagrammatically showing a modified embodiment of the optical sensor.

FIG. 32 is a view diagrammatically showing a modified embodiment of the optical sensor SC. The optical sensor SC according to this modified embodiment is common to the optical sensor SC shown in FIG. 17 except for including an aperture diaphragm DIA. Accordingly, the following description is centered on the construction of the aperture diaphragm DIA. This aperture diaphragm DIA is provided between the sensor spot SS and a light receiver Erf. Accordingly, only light having passed through the aperture diaphragm DIA out of light reflected by the transfer belt 81 can reach the light receiver Erf Further, an area Sdia of the opening of the aperture diaphragm DIA is variable, and the quantity of the light reaching the light receiver Erf can be controlled by adjusting the opening area Sdia. In other words, in this optical sensor SC, the size and shape of the sensor spot SS can be adjusted by changing the opening area Sdia. Such a function of adjusting the sensor spot SS can also be realized by providing the aperture diaphragm DIA between a light emitter Eem and the sensor spot SS. In other words, in this case, only light having passed through the aperture diaphragm DIA out of light emitted from the light emitter Eem can be reflected by the transfer belt 81 and reach the light receiver Erf. Accordingly, the quantity of the light reaching the light receiver Erf can be controlled and the size and shape of the sensor spot SS can be adjusted by changing the opening area Sdia.

As described above, in FIG. 32, the aperture diaphragm DIA is provided and the light quantity used for the detection of a detection image can be restricted thereby. As a result, the occurrence of a problem that the detection result is disturbed, for example, by stray lights can be suppressed. Since the aperture diaphragm is formed such that the quantity of light passing through this aperture diaphragm is variable, the light quantity used for the detection of a detection image can be adjusted if necessary. In other words, the size and shape of the sensor spot SS can be adjusted. Therefore, the diameter of the sensor spot SS can be easily set as in the above embodiment.

VII. Miscellaneous

As described above, in the above first to third embodiments, the main scanning direction MD and the longitudinal direction LGD correspond to a "first direction" of the invention; the sub scanning direction SD and the width direction LTD to a "second direction" of the invention. Further, in the above embodiments, the respective image forming stations Y, M, C and K and the transfer belt 81 (transfer medium) correspond to "image forming sections" of the invention; the photosensitive drum 21 to a "latent image carrier" of the invention; the optical sensor SC to a "detector" of the invention; and the sensor spot SS to a "detection area" of the invention. Further, the line head 29 corresponds to an "exposure head" of the invention; the light emitting element group 295 to "a plurality of light emitting elements" of the invention; the developer 25 to a "developing unit" of the invention. Further, the above operation of forming the test latent image TLI is performed by the controls of the main controller MC and the head controller HC, and the main controller MC and the head controller HC function as a "controller" of the invention.

In the above embodiments, it is made possible to stably detect the registration mark by detecting only one group toner image GM by means of the optical sensor SC. This one group toner image GM is obtained by developing the latent image GL formed by one light emitting element group 295, that is, obtained by developing the latent image formed by one lens LS. In other words, the registration mark is stably detected by detecting an image formed by one lens LS (imaging optical system) in the above embodiments, and "one group toner image GM" corresponds to an "image formed by one imaging optical system" of the invention.

As described above, an embodiment of an image forming apparatus according to the invention comprises an exposure head, a latent image carrier, a developing unit, and a detector The exposure head includes a plurality of imaging optical systems which are arranged in a first direction and a plurality of light emitting elements which emit lights to be focused by the imaging optical systems. The latent image carrier moves in a second direction orthogonal to or substantially orthogonal to the first direction and carries a latent image which is formed by the exposure head. The developing unit develops the latent image formed on the latent image carrier by the exposure head. The detector detects an image which is developed by the developing unit and is formed using one imaging optical system.

An embodiment of an image forming method according to the invention comprises the steps of: forming a latent image by an exposure head that includes a plurality of imaging optical systems which are arranged in a first direction and a plurality of light emitting elements which emit lights to be focused by the imaging optical systems using one imaging optical system; developing the latent image formed by the exposure head; detecting an image developed in the developing; and forming an image based on a detection result in the detecting.

An embodiment of an image detecting method according to the invention comprises the steps of: forming a latent image, by means of an exposure head that includes a plurality of imaging optical systems which are arranged in a first direction and a plurality of light emitting elements which emit lights to be focused by the imaging optical systems, on a latent image carrier that moves in a second direction orthogonal to or substantially orthogonal to the first direction; developing the latent image formed by the exposure head; and detecting an image that is developed in the developing and is formed using one imaging optical system.

In the invention (image forming apparatus, image forming method, image detecting method) thus constructed, an image formed using one imaging optical system is detected. Therefore, the image can be stably detected regardless of the image variation as described above.

Further, in the above embodiments, a transfer medium to which an image is transferred from the latent image carrier may be provided and the detector may detect the image transferred to the transfer medium. At this time, a plurality of latent image carriers to each of which the exposure head and the developing unit are arranged opposed may be arranged opposed to the transfer medium. A controller that obtains information on transferred positions of images from a detection result of the detector may be provided. The application of the invention is preferable for such a construction. This is because image detection can be satisfactorily performed to properly obtain information on transferred positions of images by applying the invention. Further, the controller enables to satisfactorily form a color image by controlling an image position of each of a plurality of different colors based on this information.

As shown in the first embodiment and in FIG. 22, a detection area of the detector on the transfer medium may be formed to have a width smaller than the image formed using one imaging optical system. By such a construction, the image can be stably detected regardless of the image variation described above by detecting the image formed using one imaging optical system by means of the detector.

As shown in FIG. 32 and the like, the detector may include a light emitter that emits light to the detection area and a light receiver that receives the light reflected from the detection area and may detect the image based on the light received by the light receiver. At this time, an aperture diaphragm may be disposed between the light emitter and the detection area or between the detection area and the light receiver. In the case of such a construction, the occurrence of a problem that the detection result is disturbed, for example, by stray lights can be suppressed since the light quantity used for the detection of an image can be restricted by the aperture diaphragm. The aperture diaphragm may be formed so constructed and arranged that the quantity of light passing through this aperture diaphragm is variable. Such a construction is advantageous in performing satisfactory image detection since the light quantity used for the detection of an image can be adjusted if necessary.

An embodiment of an image forming apparatus according to another aspect of the invention comprises an image forming section and a detector. The image forming section includes a latent image carrier whose surface moves in a second direction orthogonal to or substantially orthogonal to a first direction and is adapted to form a detection image by developing a latent image formed by exposing the surface of the latent image carrier by means of a line head. The detector detects the detection image. The line head includes a plurality of light emitting elements grouped into light emitting element groups. The respective light emitting element groups expose regions mutually different in the first direction by emitting light beams toward the surface of the latent image carrier. An image formed by developing a latent image formed by one light emitting element group is a group image. The detection image is made up of at least one group image, and the detection image is detected by detecting one group image by means of the detector.

An embodiment of an image forming method according to another aspect of the invention comprises a detection image forming step and a detection step. The detection image forming step is a step of forming a detection image by developing a latent image formed by exposing a surface of a latent image carrier moving in a second direction orthogonal to or substantially orthogonal to a first direction by means of a line head. The detection step is a step of detecting the detection image. The line head includes a plurality of light emitting elements grouped into light emitting element groups. The respective light emitting element groups expose regions mutually different in the first direction by emitting light beams toward the surface of the latent image carrier. An image formed by developing a latent image formed by one light emitting element group is a group image. The detection image is made up of at least one group image, and the detection image is detected by detecting one group image in the detection step.

In the embodiment (image forming apparatus, image forming method) thus constructed, a detection image is detected by detecting one group image. Therefore, the detection result of the detection image can be stably obtained regardless of the detection image variation as described above.

The detection image may be made up of one group image. In the case of such a construction, the detection result of the detection image can be stably obtained regardless of the detection image variation as described above since the detection image is detected by detecting one group image.

At this time, the group image may be formed by all the light emitting elements belonging to the light emitting element group. In the case of such a construction, the width of the group image in the first direction can be maximized, wherefore the detection result of the detection image can be stably obtained.

The embodiment may be configured as follows in the case where the light emitting element group includes a plurality of light emitting element rows, in each of which a plurality of light emitting elements are aligned in a direction corresponding to the first direction, arranged in a direction corresponding to the second direction. Specifically, as described later with reference to FIGS. 33 and 34, a group image may be formed by one of the plurality of light emitting element rows belonging to the light emitting element group. Such a construction enables the detection result of a detection image to be more stably obtained.

Further, as described in the first embodiment with reference to FIG. 22 and the like, the detection image may be conveyed in a conveying direction orthogonal to or substantially orthogonal to the first direction, the detector may detect the detection image passing the detection area in the conveying direction, the width of the detection area may be smaller than the width in the first direction of a latent image formed by all the light emitting elements belonging to one light emitting element group, and one of group images constituting the detection image may pass the detection area. In the case of such a construction, the detection result of the detection image can be stably obtained regardless of the detection image variation as described above since the detection image is detected by detecting one group image.

The embodiment may be configured as follows in the case where the image forming section includes image forming stations of a plurality of colors, each being provided with a latent image carrier and a line head, for forming detection images of the respective plurality of colors on the surface of the transfer medium moving in the conveying direction, and the image forming stations form the detection images of the corresponding colors on the transfer medium, as described above. Specifically, one detector facing the transfer medium may detect the detection images of the respective colors successively passing the detection area in the conveying direction, and the line head of each color may be positioned such that one of the group images constituting the detection image formed by the line head passes the detection area. By such a construction, the detection images of the respective plurality of colors can be detected by one detector, whereby the simplification of the apparatus construction can be realized.

It should be noted that the invention is not limited to the embodiment above, but may be modified in various manners in addition to the embodiment above, to the extent not deviating from the object of the invention. For example, the registration mark RM is made up of eight group toner images GM in the first embodiment, but it is not essential for the invention to configure the registration mark RM in this way. In short, it is sufficient that the registration mark RM is made up of at least one group toner image GM.

Although one group toner image GM constituting the registration mark RM is formed by all the light emitting elements 2951 belonging to the light emitting element group 295 in the second embodiment, the group toner image GM may be formed by some of light emitting elements 2951 belonging to the light emitting element group 295.

In the above embodiments, the light emitting element group 295 includes eight light emitting elements 2951. However, the number of the light emitting elements 2951 constituting the light emitting element group 295 is not limited to this and may be 2 or greater.

Figure 33:
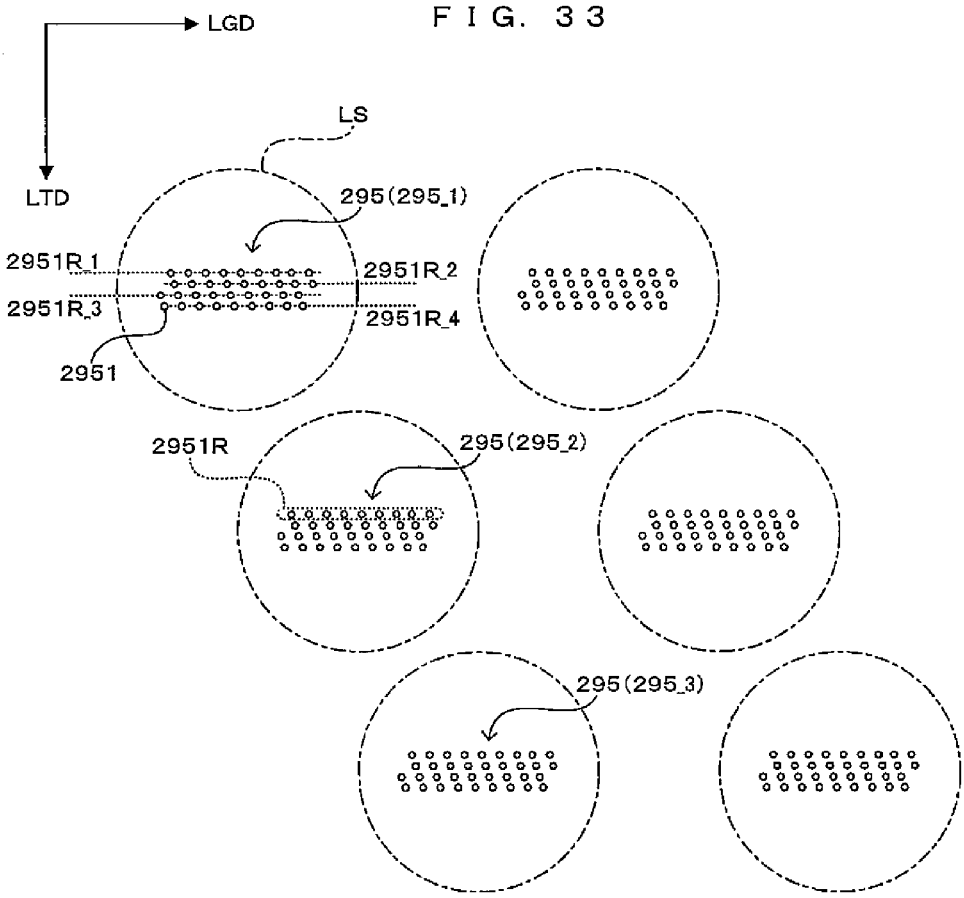
FIG. 33 is a diagram showing another configuration of light emitting element groups.

Although the light emitting element group 295 is made up of two light emitting element rows 2951R in the above embodiments, the number of the light emitting element rows 2951R constituting the light emitting element group 295 is not limited to this. FIG. 33 is a diagram showing another configuration of light emitting element groups. In an example shown in FIG. 33, four light emitting element rows 2951R_1 to 2951R_4 are arranged in the width direction LTD in each light emitting element group 295. Each of the light emitting element rows 2951R_1 to 2951R_4 is made up of nine light emitting elements 2951 aligned in the longitudinal direction LGD. The respective light emitting element rows 2951R_1 to 2951R_4 are relatively displaced in the longitudinal direction LGD, with the result that the positions of the respective light emitting elements 2951 differ in the longitudinal direction LGD. As the surface of the photosensitive drum 21 moves in the sub scanning direction SD, the respective light emitting element rows 2951R_1 to 2951R_4 emit light beams at specified timings. The light beams emitted from the light emitting element rows are imaged by the lenses LS to form spots on the photosensitive drum surface. It should be noted that the lenses LS are inverted lenses for forming inverted images. In this way, a line latent image continuous in the main scanning direction MD can be formed on the photosensitive drum surface. This is described in detail with reference to FIG. 34.

Figure 34:
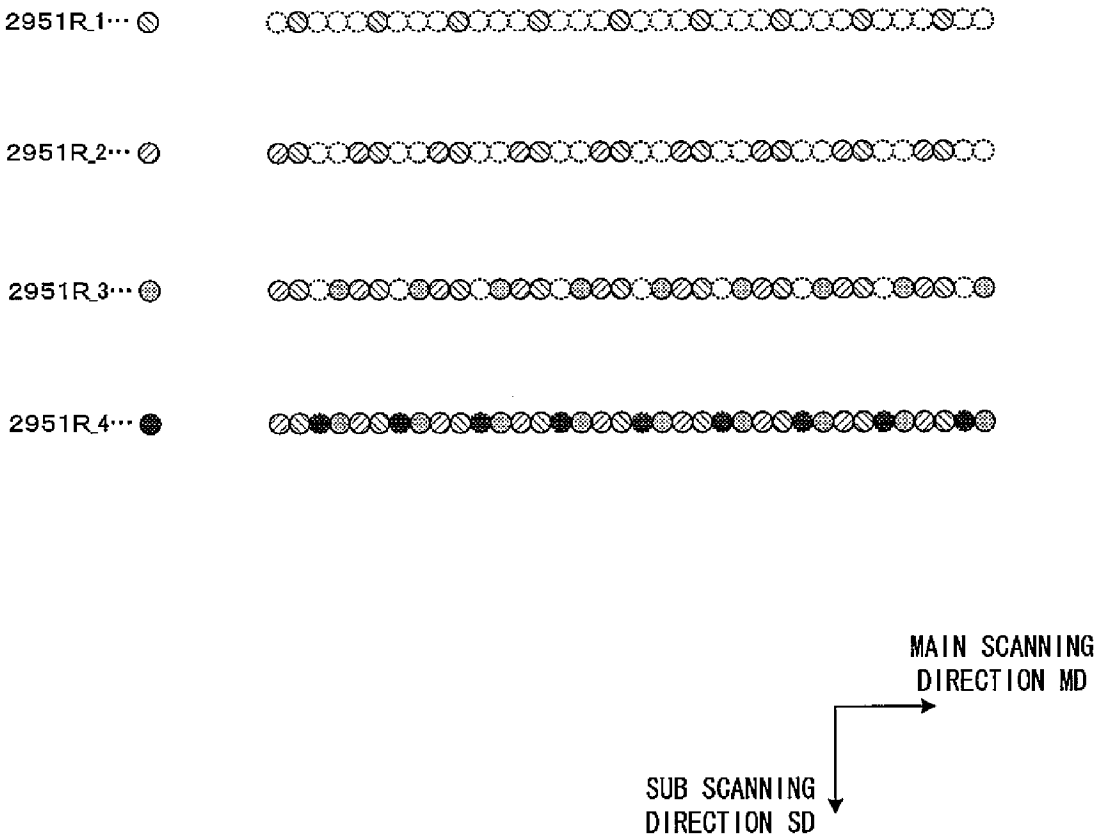
FIG. 34 is a diagram showing a line latent image forming operation of the light emitting element group.

FIG. 34 is a diagram showing a line latent image forming operation of the light emitting element group. First of all, the most upstream light emitting element row 2951R_1 in the width direction LTD corresponding to the sub scanning direction SD emits light beams, whereby spots are formed at patched positions of "2951R_1" of FIG. 34. In FIG. 34, white circles represent spots that are not formed yet, but planned to be formed later. Subsequently, when the second light emitting element row 2951R_2 from the upstream side in the width direction LTD emits light beams, spots are formed at patched positions of "2951R_2" of FIG. 34. Further, after the third light emitting element row 2951R_3 from the upstream side in the width direction LTD emits light beams to form spots at patched positions of "2951R_3" of FIG. 34, the fourth light emitting element row 2951R_4 from the upstream side in the width direction LTD emits light beams to form spots at patched positions of "2951R_4" of FIG. 34. In this way, the line latent image is formed.

In the above second embodiment, one group toner image GM constituting the registration mark RM is formed by all the light emitting elements 2951 belonging to the light emitting element group 295. However, in the example shown in FIGS. 33 and 34, as the surface of the photosensitive drum 21 moves in the sub scanning direction SD, the respective light emitting element rows 2951R_1 to 2951R_4 emit light beams at specified timings to perform the latent image forming operation. Accordingly, if the moving speed of the photosensitive drum surface varies during a period which elapses until the next light emitting element row 2951R emits light beams after a certain light emitting element row 2951R emits light beams, the positions of spots formed by the respective light emitting element rows 2951R may be slightly displaced in the sub scanning direction SD in some cases. As a result, the edges of the group toner images GM are slightly zigzagged in some cases. Thus, each group toner image GM constituting the registration mark RM may be formed by only one light emitting element row 2951R. If the group toner images GM are formed in this way, the edges of the group toner images GM become substantially linear, with the result that the detection result on the registration mark RM can be made more stable.

As described above, in the embodiment shown in FIGS. 33 and 34, the light emitting element row 2951R corresponds to "light emitting elements arranged in the first direction" of the invention.

In other words, an image is formed by the light emitting elements arranged in the first direction, with the result that the detection result on the image can be made more stable.

Figure 35:
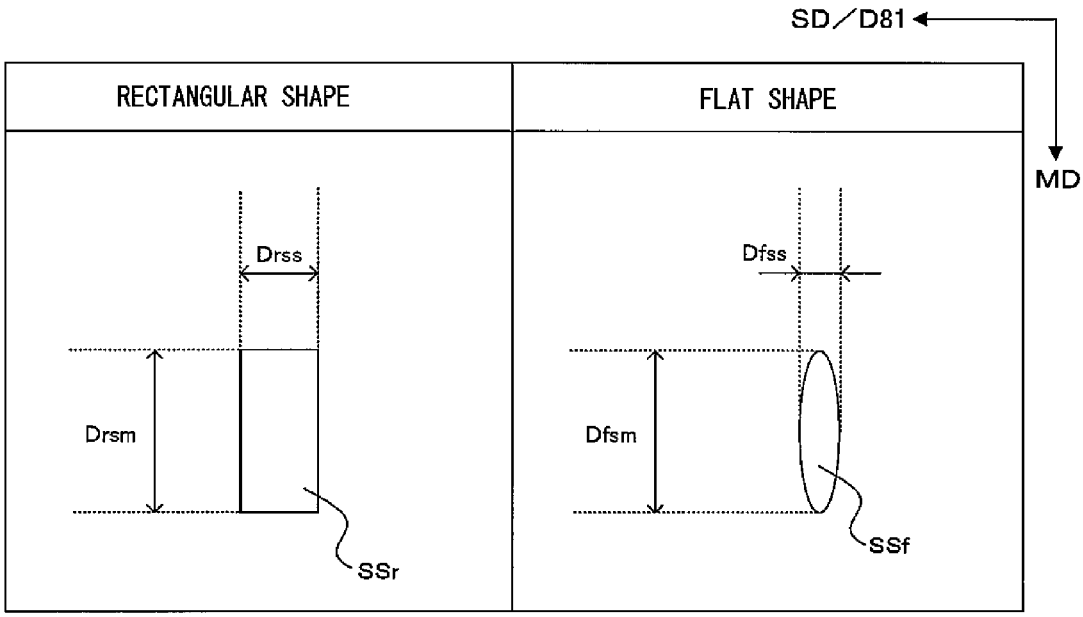
FIG. 35 is a group of diagrams showing modified examples of the shape of the sensor spot.

Although the sensor spot SS has a round shape in the above embodiments, the shape thereof is not limited to this and the sensor spot SS may have a shape as shown in FIG. 35. FIG. 35 is a group of diagrams showing modified examples of the shape of the sensor spot. The sensor spot SS may have a rectangular shape as shown in the column "RECTANGULAR SHAPE" of FIG. 35. In a rectangular sensor spot SSr, a main-scanning spot diameter Drsm and a sub-scanning spot diameter Drss can be defined as shown in FIG. 35. In other words, the width of the rectangular sensor spot SSr in the main scanning direction MD is the main-scanning spot diameter Drsm and the width thereof in the sub scanning direction SD is the sub-scanning spot diameter Drss. The sensor spot SS may have a flat shape as shown in the column "FLAT SHAPE" of FIG. 35. In a flat sensor spot SSf, a main-scanning spot diameter Dfsm and a sub-scanning spot diameter Dfss can be defined as shown in FIG. 35. In other words, the width of the flat sensor spot SSf in the main scanning direction MD is the main-scanning spot diameter Dfsm and the width thereof in the sub scanning direction SD is the sub-scanning spot diameter Dfss.

In the above embodiments, organic EL devices are used as the light emitting elements 2951. However, devices usable as the light emitting elements 2951 are not limited to organic EL devices and LEDs (light emitting diodes) may also be used as the light emitting elements 2951.

In the case of using organic EL devices, particularly bottom-emission type EL devices as the light emitting elements 2951, emitted light quantities tend to decrease and an image to be formed is easily influenced by stray lights and the like. Accordingly, in such a case, the light shielding member 297 described with reference to FIG. 4 and other figures is preferably provided to suppress the influence of stray lights.

In the above embodiments, a plurality of (eight in the above) light emitting elements 2951 are arranged while being grouped into the light emitting element group 295. However, a plurality of light emitting elements 2951 can also be arranged as follows without being grouped.

Figure 36:
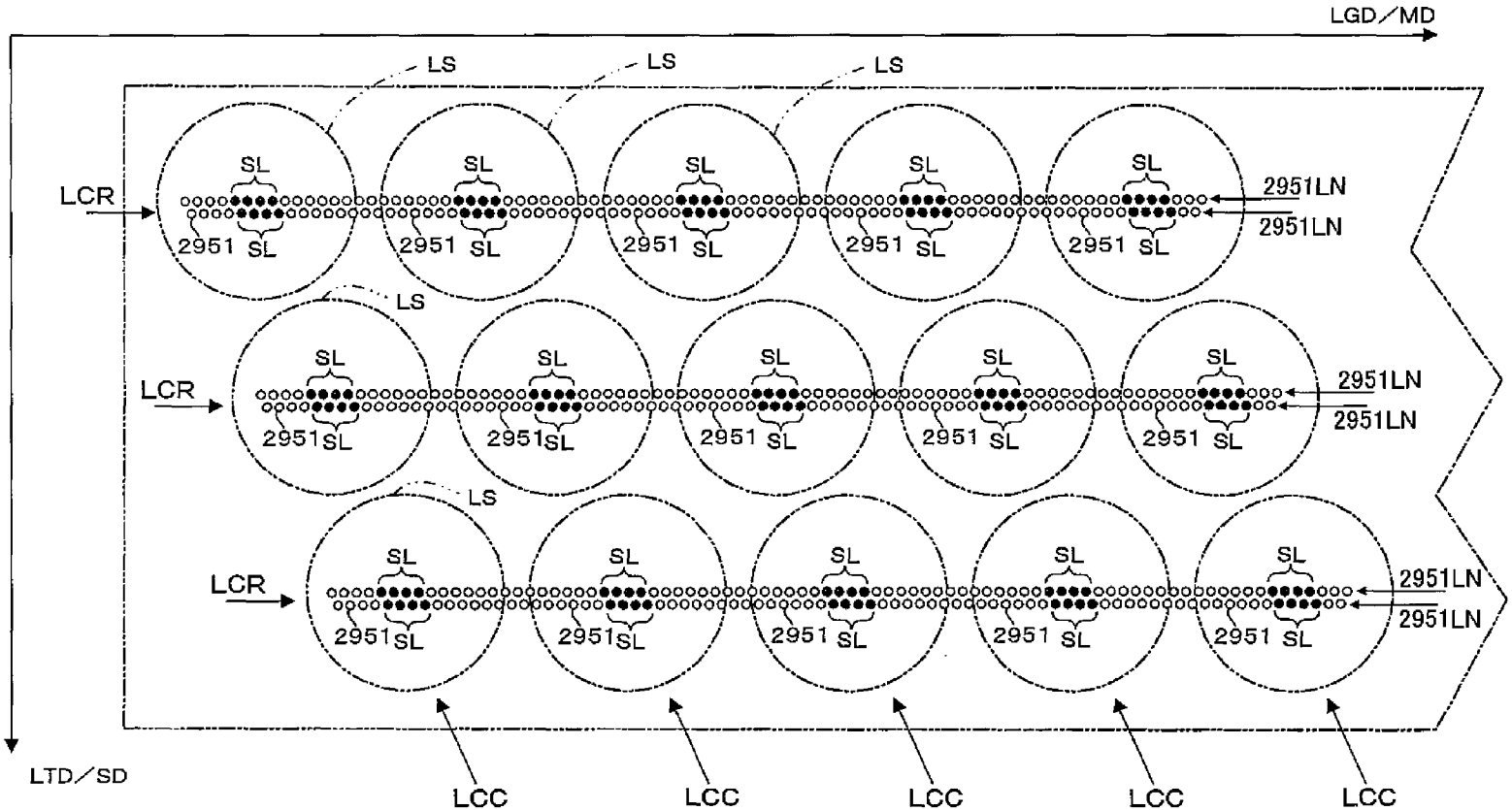
FIG. 36 is a plan view showing another arrangement mode of light emitting elements.

FIG. 36 is a plan view showing another arrangement mode of light emitting elements. As shown in FIG. 36, a plurality of light emitting elements 2951 are aligned in the longitudinal direction LGD to form a light emitting element line 2951LN. Two light emitting element lines 2951LN are provided for one lens row LCR, and the two light emitting element lines 2951LN corresponding to the same lens row LCR are relatively displaced in the longitudinal direction LGD. As a result, the positions of the respective light emitting elements 2951 corresponding to the same lens row LCR differ in the longitudinal direction LGD. It should be noted that the number of the light emitting element lines 2951LN corresponding to one lens row LCR is not limited to two, and may be one, three or more. However, in the case of providing a plurality of light emitting element lines 2951LN, the respective light emitting element lines 2951LN are relatively displaced in the longitudinal direction LGD so that the positions of the respective light emitting elements 2951 corresponding to the same lens row LCR differ from each other in the longitudinal direction LGD.

Figure 37:
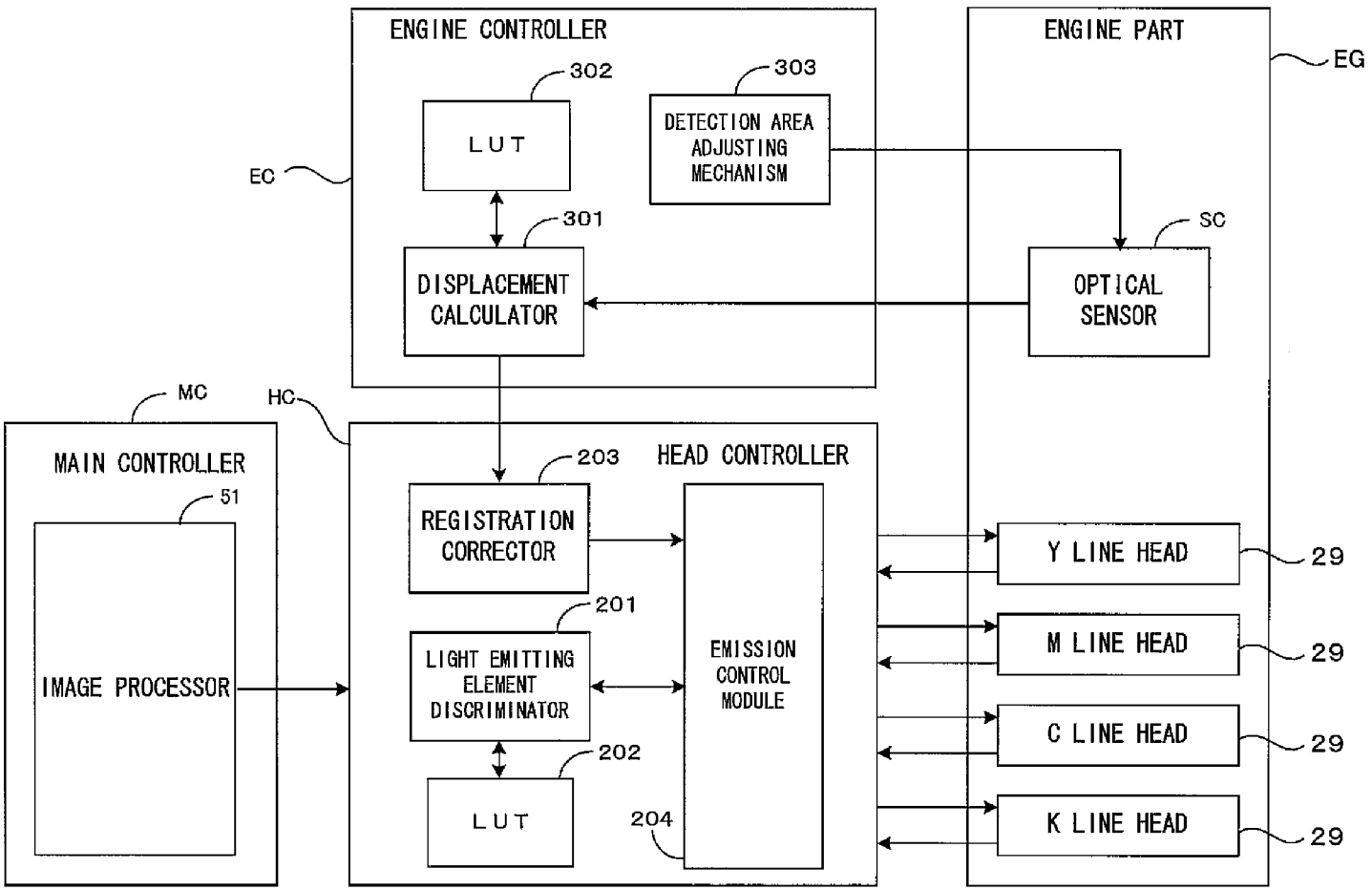
FIG. 37 is a block diagram showing the electrical construction of an image forming apparatus provided with the line heads of FIG. 36.

FIG. 37 is a block diagram showing the electrical construction of an image forming apparatus provided with the line heads of FIG. 36. An engine part EG includes an optical sensor SC capable of adjusting the size and shape of a sensor spot SS by adjusting an opening area Sdia as shown in FIG. 32, and a registration mark RM is detected by this optical sensor SC. On the other hand, an engine controller EC for controlling this engine part EG includes a displacement calculator 301, a LUT (look-up table) 302 and a detection area adjusting mechanism 303. The displacement calculator 301 calculates a displacement based on the detection result on the registration mark RM inputted from the optical sensor SC and the stored content of the LUT 302. In other words, detection results of the optical sensor and displacements are stored being associated with each other in the LUT 302, and the displacement calculator 301 obtains the displacement by comparing the detection result on the registration mark and the stored content of the LUT 302. The displacement obtained by the displacement calculator 301 is outputted to a head controller HC to be used for the emission control of the light emitting elements of the line heads 29.

The head controller HC includes a registration corrector 203 which calculates correction amounts of emission timings of the light emitting elements 2951 based on the inputted displacement. The head controller HC further includes a light emitting element discriminator 201, a LUT 202 and an emission control module 204 in addition to the registration corrector 203. The lenses LS and the light emitting elements 2951 corresponding to the lenses LS are stored in the LUT 202, and the light emitting element discriminator 201 discriminates the light emitting elements 2951 corresponding to the respective lenses LS by referring to the LUT 202. The light emitting elements thus discriminated are used light emitting elements SL hatched in FIG. 36, and the lens LS and eight used light emitting elements SL located in a chain double-dashed line circle representing the lens LS correspond to each other. Lights emitted from the used light emitting elements SL are imaged by the corresponding lenses LS to form a latent image on the surface of the photosensitive drum 21. The emission control module 204 drives the respective used light emitting elements SL to emit lights while correcting the emission timings of the used light emitting elements SL by the correction amounts calculated by the registration corrector 203.

Figure 38:
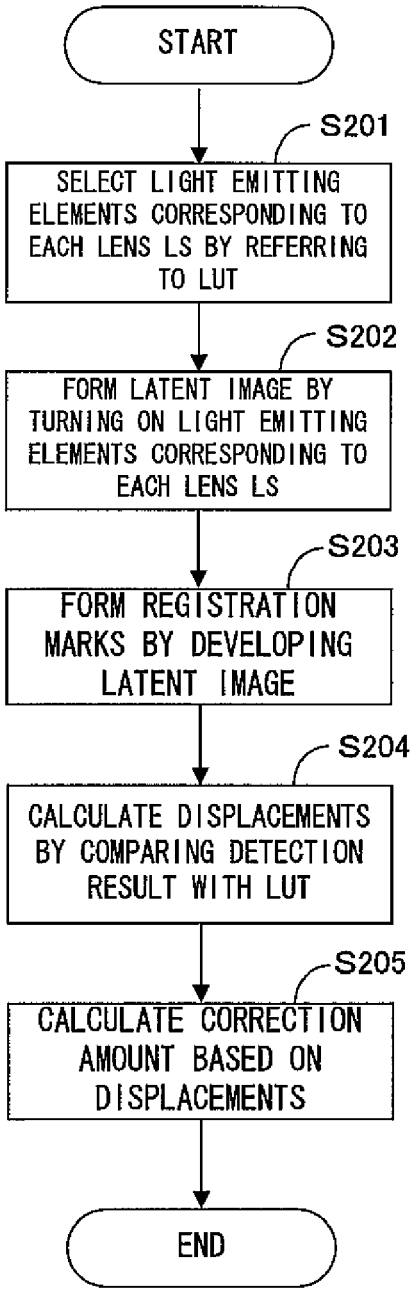
FIG. 38 is a flow chart showing a registration mark detecting operation performed in the image forming apparatus shown in FIGS. 36 and 37.

FIG. 38 is a flow chart showing a registration mark detecting operation performed in the image forming apparatus shown in FIGS. 36 and 37. In Step S201, the light emitting element discriminator 201 of the head controller HC selects the used light emitting elements SL for each lens LS by referring to the LUT (look-up table) 202. In Step S202, toner latent images TLI are formed by these used light emitting elements SL. At this time, the used light emitting elements SL corresponding to the same lens LS emit lights to form a latent image corresponding to one group latent image GL. In other words, one lens LS forms a latent image corresponding to one group latent image GL. In Step S203, the test latent images TLI thus formed are developed to form registration marks RM. Then, displacements are obtained from the detection results on the registration marks RM by the optical sensor SC and the stored content of the LUT 302 (Step S204), and the correction amounts of the emission timings of the light emitting elements are calculated based on these displacements (Step S204).

In the line head 29 shown in FIG. 36 as well, the respective used light emitting elements SL emit lights at timings in conformity with the movement of the surface of the photosensitive drum 21 in the sub scanning direction SD to form the test latent image TLI. Accordingly, if the surface speed of the photosensitive drum 21 varies, the latent images formed by different lenses LS (i.e. latent images corresponding to the group latent images GL) may vary in the sub scanning direction SD in some cases. Consequently, it is preferable to detect the registration mark by configuring the sensor spot SS of the optical sensor SC and the registration mark RM as in the above embodiments. In other words, the registration mark RM can be stably detected by detecting the toner image (corresponding to the group toner image GM) obtained by developing the latent image (corresponding to the group latent image GL) formed by one lens LS by means of the optical sensor SC. In this case, the toner image obtained by developing the latent image formed by the used light emitting elements SL corresponding to the lens LS corresponds to the "image formed by one imaging optical system" of the invention.

Although the invention has been described with reference to specific embodiments, this description is not meant to be construed in a limiting sense. Various modifications of the disclosed embodiment, as well as other embodiments of the invention, will become apparent to persons skilled in the art upon reference to the description of the invention. It is therefore contemplated that the appended claims will cover any such modifications or embodiments as fall within the true scope of the invention.

What is claimed is:

1. An image forming apparatus, comprising:

an exposure head that includes a first imaging optical system, a second imaging optical system, a light shielding member having first and second light guide holes, first and second light emitting elements that are arranged in a first direction and emit light to pass the first light guide hole and to be focused by the first imaging optical system, and third and fourth light emitting elements that are arranged in the first direction and emit light to pass the second light guide hole and to be focused by the second imaging optical system, the first and second imaging optical systems being arranged in the first direction;

a latent image carrier that moves in a second direction orthogonal to or substantially orthogonal to the first direction and carries a latent image that is formed by the exposure head;

a developing unit that develops the latent image formed on the latent image carrier by the exposure head;

a detector that detects an image that is developed by the developing unit and is formed using the first and second light emitting elements; and a transfer medium to which the image is to be transferred from the latent image carrier, wherein the detector detects the image transferred to the transfer medium, and the detector has a detection area on the transfer medium whose width is smaller than the image formed by the exposure head using the first and second light emitting elements.

2. The image forming apparatus according to claim 1, wherein the latent image carrier to which the exposure head and the developing unit are arranged opposed is arranged opposed to the transfer medium.

3. The image forming apparatus according to claim 2, comprising a controller that obtains information on a transferred position of the image from a detection result of the detector.

4. The image forming apparatus according to claim 3, wherein the controller controls an image position based on the information.

5. The image forming apparatus according to claim 1, wherein the detector includes a light emitter that emits a light to the detection area and a light receiver that receives the light reflected from the detection area, and detects the image based on the light received by the light receiver.

6. The image forming apparatus according to claim 5, comprising an aperture diaphragm that is arranged between the light emitter and the detection area or between the detection area and the light receiver.

7. The image forming apparatus according to claim 6, wherein the aperture diaphragm is so constructed and arranged that a quantity of light passing therethrough is variable.

8. The image forming apparatus according to claim 1, wherein the first and second light emitting elements are organic EL devices.

9. The image forming apparatus according to claim 8, wherein the organic EL device is of the bottom-emission type.

10. An image forming method, comprising:

forming a latent image on a latent image carrier by an exposure head that includes a first imaging optical system, a second imaging optical system, a light shielding member having first and second light guide holes, first and second light emitting elements that are arranged in a first direction and emit light to pass the first light guide hole and to be focused by the first imaging optical system, and third and fourth light emitting elements that are arranged in the first direction and emit light to pass the second light guide hole and to be focused by the second imaging optical system, the first and second imaging optical systems being arranged in the first direction;

developing the latent image formed by the exposure head using the first and second light emitting elements;

detecting an image developed in the developing by a detector;

forming an image based on a detection result in the detecting;

transferring the image from the latent image carrier to a transfer medium;

detecting the image transferred to the transfer medium by the detector, wherein the detector has a detection area on the transfer medium whose width is smaller than the image formed by the exposure head using the first and second light emitting elements.

11. An image detecting method, comprising:

forming a latent image on a latent image carrier, by means of an exposure head that includes a first imaging optical system, a second imaging optical system, a light shielding member having first and second light guide holes, first and second light emitting elements that are arranged in a first direction and emit light to pass the first light guide hole and to be focused by the first imaging optical system, and third and fourth light emitting elements that are arranged in the first direction and emit light to pass the second light guide hole and to be focused by the second imaging optical system, the first and second optical systems being arranged in the first direction, the latent image carrier moving in a second direction orthogonal to or substantially orthogonal to the first direction;

developing the latent image formed by the exposure head using the first and second light emitting elements; and detecting an image that is developed in the developing by a detector;

transferring the image from the latent image carrier to a transfer medium;

detecting the image transferred to the transfer medium by the detector, wherein the detector has a detection area on the transfer medium whose width is smaller than the image formed by the exposure head using the first and second light emitting elements.

* * * * *